US010907463B2

(12) United States Patent
Zheng et al.

(10) Patent No.: US 10,907,463 B2
(45) Date of Patent: Feb. 2, 2021

(54) WELL CONSTRUCTION CONTROL SYSTEM

(71) Applicant: Schlumberger Technology Corporation, Sugar Land, TX (US)

(72) Inventors: Shunfeng Zheng, Katy, TX (US); Joergen K. Johnsen, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 14 days.

(21) Appl. No.: 15/701,855

(22) Filed: Sep. 12, 2017

(65) Prior Publication Data

US 2019/0078426 A1 Mar. 14, 2019

(51) Int. Cl.

| | |
|---|---|
| ***E21B 44/00*** | (2006.01) |
| ***E21B 19/00*** | (2006.01) |
| ***E21B 21/08*** | (2006.01) |
| ***E21B 33/06*** | (2006.01) |
| ***E21B 19/14*** | (2006.01) |
| *E21B 47/18* | (2012.01) |

(52) U.S. Cl.

CPC ..... *E21B 44/00* (2013.01); *E21B 19/008* (2013.01); *E21B 19/14* (2013.01); *E21B 21/08* (2013.01); *E21B 33/06* (2013.01); *E21B 33/063* (2013.01); *E21B 47/18* (2013.01)

(58) Field of Classification Search

CPC ..... E21B 44/00; E21B 33/063; E21B 21/08; E21B 19/008; E21B 47/18

See application file for complete search history.

(56) References Cited

U.S. PATENT DOCUMENTS

| | | | | |
|---|---|---|---|---|
| 4,384,612 | A * | 5/1983 | Bradford | E21B 34/16 137/554 |
| 5,959,547 | A | 9/1999 | Tubel et al. | |
| 6,931,621 | B2 | 8/2005 | Green et al. | |
| 7,264,050 | B2 | 9/2007 | Koithan et al. | |
| 7,895,220 | B2 | 2/2011 | Evans et al. | |
| 7,945,488 | B2 | 5/2011 | Karr et al. | |
| 8,103,493 | B2 | 1/2012 | Sagert et al. | |
| 8,121,971 | B2 | 2/2012 | Edwards et al. | |
| 8,145,464 | B2 | 3/2012 | Arnegaard et al. | |

(Continued)

FOREIGN PATENT DOCUMENTS

| | | |
|---|---|---|
| WO | 2013074095 A1 | 5/2013 |
| WO | 2018142173 A1 | 8/2018 |

*Primary Examiner* — Brad Harcourt
(74) *Attorney, Agent, or Firm* — Rachel E. Greene

(57) ABSTRACT

Apparatus and methods for a well construction system and a wellsite control system. The construction system is for forming a wellbore at an oil and gas wellsite. The construction system includes rig and well pressure control systems. The rig control system is for selectively moving a drill string within the wellbore, and includes a first actuator for actuating at least a portion of the rig control system. The well pressure control system is for controlling pressure within the wellbore, and includes a second actuator for actuating at least a portion of the well pressure control system. The wellsite control system is communicatively connected with the first and second actuators, and is operable to generate first and second control signals to operate the first and second actuators, respectively. The first control signal is determined based on the computer program code and the second control signal.

12 Claims, 6 Drawing Sheets

(56) References Cited

U.S. PATENT DOCUMENTS

| | | | |
|---|---|---|---|
| 8,215,417 | B2 | 7/2012 | Annaiyappa et al. |
| 9,223,594 | B2 | 12/2015 | Brown et al. |
| 9,388,681 | B2 | 7/2016 | Dykstra et al. |
| 9,441,428 | B1 | 9/2016 | Barnes et al. |
| 9,482,083 | B2 | 11/2016 | Doris |
| 2002/0060093 | A1 | 5/2002 | Womer et al. |
| 2003/0212898 | A1 | 11/2003 | Steele et al. |
| 2008/0173480 | A1 | 7/2008 | Annaiyappa et al. |
| 2011/0232966 | A1 | 9/2011 | Kyllingstad |
| 2012/0255778 | A1 | 10/2012 | Reckmann et al. |
| 2013/0127900 | A1 | 5/2013 | Pena et al. |
| 2014/0353033 | A1 | 12/2014 | Pink et al. |
| 2015/0369030 | A1 | 12/2015 | Hay et al. |
| 2016/0168973 | A1 | 6/2016 | Dykstra et al. |
| 2016/0194946 | A1 | 7/2016 | Dykstra et al. |
| 2016/0222775 | A1 | 8/2016 | Tunc et al. |
| 2017/0167200 | A1 | 6/2017 | Zheng et al. |
| 2018/0163527 | A1* | 6/2018 | Curry ..... E21B 44/00 |

* cited by examiner

WELL CONSTRUCTION CONTROL SYSTEM

BACKGROUND OF THE DISCLOSURE

Wells are generally drilled into the ground or ocean bed to recover natural deposits of oil and gas, and other desirable materials that are trapped in subterranean formations. Such wells are drilled into the subterranean formations using a drill bit attached to a lower end of a drill string. Drilling fluid is pumped from a wellsite surface down through the drill string to the drill bit. The drilling fluid lubricates and cools the drill bit, and carries drill cuttings from the wellbore to the wellsite surface.

Such well construction process utilizes a plurality of machines and other wellsite equipment operating in a coordinated manner. The wellsite equipment is typically grouped into several subsystems, wherein each subsystem performs a specific operation or a series of operations and is controlled by a corresponding controller. The subsystems may include a rig control (RC) system, a fluid control (FC) system, a managed pressure drilling control (MPDC), a gas monitoring (GM) system, a closed circuit television (CCTV) system, a choke pressure control (CPC) system, and a well control (WC) system (also referred to as Well Pressure Control System), among other examples.

Each controller is typically implemented as a standalone controller operable to execute processes associated with the corresponding subsystem. Although wellsite equipment may operate in a coordinated manner, there is little or no communication between the subsystems and their controllers, whereby interactions between the subsystems are typically initiated by human operators (e.g., drillers). The operators play an integral part in the control of the individual subsystems, for example, by monitoring the subsystems to identify operational and safety events and initiating processes to counteract such events. Relying on human operators to monitor the subsystems and initiate processes limits speed, efficiency, and safety of the well construction process.

SUMMARY OF THE DISCLOSURE

This summary is provided to introduce a selection of concepts that are further described below in the detailed description. This summary is not intended to identify indispensable features of the claimed subject matter, nor is it intended for use as an aid in limiting the scope of the claimed subject matter.

The present disclosure introduces an apparatus including a well construction system and a wellsite control system. The well construction system is operable to form a wellbore within a subterranean formation at an oil and gas wellsite. The well construction system includes a rig control system and a well pressure control system. The rig control system is operable to selectively move a drill string within the wellbore, and includes a first actuator operable to actuate at least a portion of the rig control system. The well pressure control system is operable to control pressure within the wellbore, and includes a second actuator operable to actuate at least a portion of the well pressure control system. The wellsite control system includes a processor and a memory storing computer program code. The wellsite control system is communicatively connected with the first actuator and the second actuator. The wellsite control system is operable to generate a first control signal to operate the first actuator. The wellsite control system is also operable to generate a second control signal to operate the second actuator. The first control signal is determined based on the computer program code and the second control signal.

The present disclosure also introduces an apparatus including a control system for an oil and gas well construction system at a wellsite. The control system includes a processor and a memory storing computer program code. The control system is operable to receive sensor information from sensors of subsystems of the well construction system, generate control signals to operate actuators of the subsystems, display on a video output device the received sensor information, and detect an event associated with one or more of the subsystems based on the received sensor information.

The present disclosure also introduces a method including operating a control system of an oil and gas well construction system. The control system includes a processor and memory including computer program code. Operating the control system includes receiving sensor information generated by sensors of the well construction system, displaying the sensor information on a video output device, and monitoring the sensor information to detect an operational event at the well construction system. The method also includes, upon detection of the operational event, displaying on the video output device information indicative of the detected operational event and a counteractive measure to be implemented in response to the detected operational event.

The present disclosure also introduces an apparatus including a control system having a processor and a memory storing computer program code. The control system is communicatively connected with sensors of each subsystem of a well construction system. The control system is communicatively connected with actuators of each subsystem. The control system is operable for generating, on a video output device, a display screen including a subsystem selection menu listing the subsystems. The subsystem selection menu is operable by a human operator for selecting one or more of the subsystems. The display screen also includes a subsystem information area showing information generated by the sensors of the selected one or more of the subsystems. The display screen also includes an operational event area showing information indicative of an operational event detected at the well construction system, and information indicative of a counteractive measure to be implemented in response to the detected operational event.

These and additional aspects of the present disclosure are set forth in the description that follows, and/or may be learned by a person having ordinary skill in the art by reading the materials herein and/or practicing the principles described herein. At least some aspects of the present disclosure may be achieved via means recited in the attached claims.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
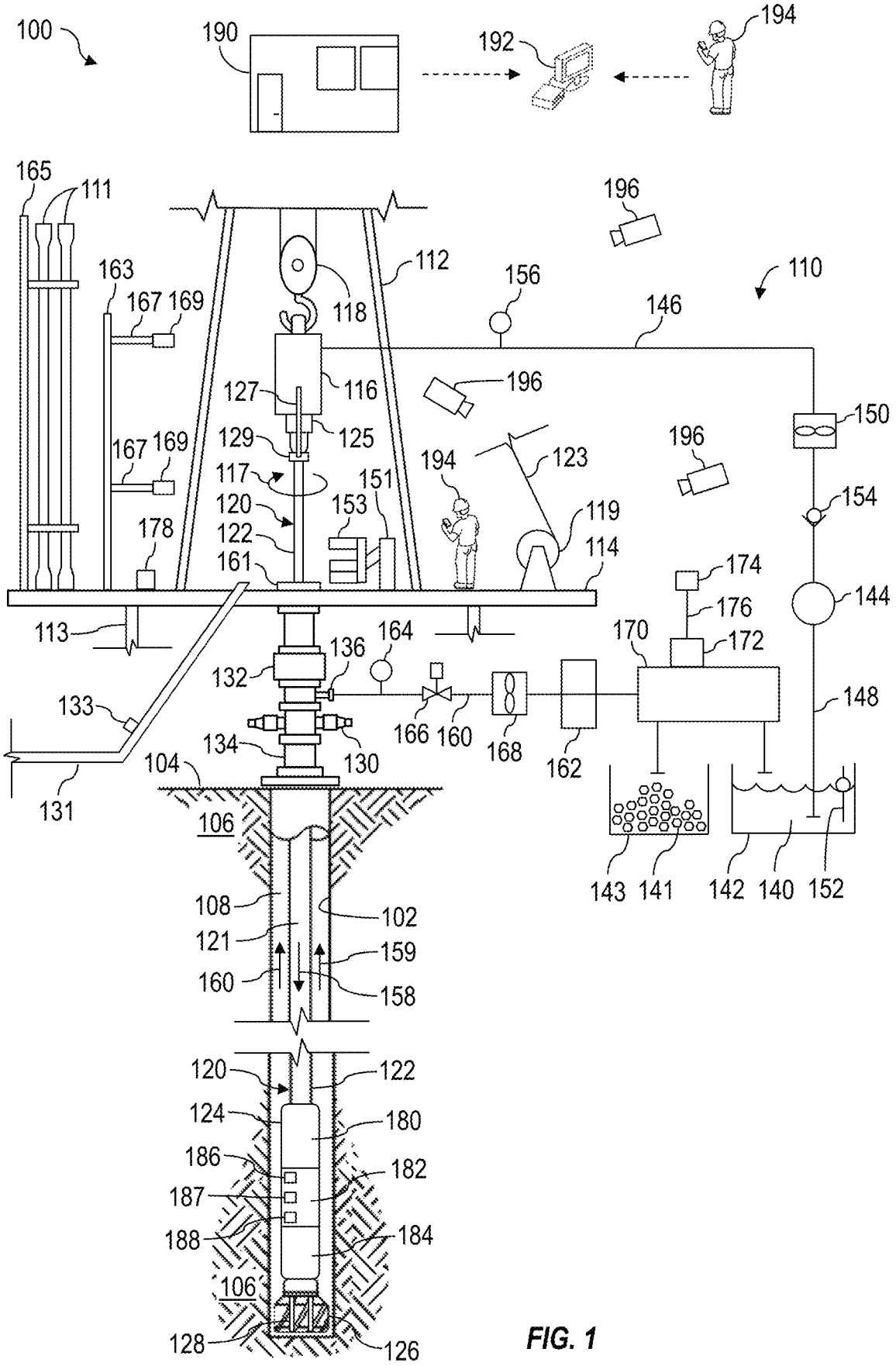
FIG. 1 is a schematic view of at least a portion of an example implementation of apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for simplicity and clarity, and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

FIG. 1 is a schematic view of at least a portion of an example implementation of a well construction system 100 according to one or more aspects of the present disclosure. The well construction system 100 represents an example environment in which one or more aspects described below may be implemented. It is also noted that although the well construction system 100 is depicted as an onshore implementation, it is understood that the aspects described below are also generally applicable to offshore and inshore implementations.

The well construction system 100 is depicted in relation to a wellbore 102 formed by rotary and/or directional drilling from a wellsite surface 104 and extending into a subterranean formation 106. The well construction system 100 includes surface equipment 110 located at the wellsite surface 104 and a drill string 120 suspended within the wellbore 102. The surface equipment 110 may include a mast, a derrick, and/or another wellsite structure 112 disposed over a rig floor 114. The wellsite structure 112 and the rig floor 114 are collectively supported over the wellbore 102 by a plurality of legs or other support structures 113. The drill string 120 may be suspended within the wellbore 102 from the wellsite structure 112.

The drill string 120 may comprise a BHA 124 and means 122 for conveying the BHA 124 within the wellbore 102. The conveyance means 122 may comprise drill pipe, heavy-weight drill pipe (HWDP), wired drill pipe (WDP), tough logging condition (TLC) pipe, coiled tubing, and/or other means of conveying the BHA 124 within the wellbore 102. A downhole end of the BHA 124 may include or be coupled to a drill bit 126. Rotation of the drill bit 126 and the weight of the drill string 120 may collectively operate to advance the BHA 124 into the formation 106 to form the wellbore 102. The drill bit 126 may be rotated from the wellsite surface 104 and/or via a downhole mud motor (not shown) connected with the drill bit 126.

The BHA 124 may also include various downhole tools 180, 182, 184. One or more of such downhole tools 180, 182, 184 may be or comprise an acoustic tool, a density tool, a directional drilling tool, an electromagnetic (EM) tool, a sampling while drilling (SWD) tool, a formation testing tool, a formation sampling tool, a gravity tool, a monitoring tool, a neutron tool, a nuclear tool, a photoelectric factor tool, a porosity tool, a reservoir characterization tool, a resistivity tool, a seismic tool, a surveying tool, and/or a tough logging condition (TLC) tool, although other downhole tools are also within the scope of the present disclosure. One or more of the downhole tools 180, 182, 184 may also be implemented as a measuring-while-drilling (MWD) or logging-while-drilling (LWD) tool for the acquisition and/or transmission of downhole data to the surface equipment 110.

The downhole tool 182 may be or comprise the MWD or LWD tool comprising a sensor package 186 operable for the acquisition of measurement data pertaining to the BHA 124, the wellbore 102, and/or the formation 106. The downhole tool 182 and/or another portion of the BHA 124 may also comprise a telemetry device 187 operable for communication with the surface equipment, such as via mud-pulse telemetry. The downhole tool 182 and/or another portion of the BHA 124 may also comprise a downhole processing device 188 operable to receive, process, and/or store information received from the surface equipment, the sensor package 186, and/or other portions of the BHA 124. The processing device 188 may also store executable programs and/or instructions, including for implementing one or more aspects of the operations described herein.

The wellsite structure 112 may support a top drive 116 operable to connect with an uphole end of the conveyance means 122 and impart rotary motion 117 to the conveyance means 122, the drill string 120, and the drill bit 126. However, a kelly and rotary table (neither shown) may be utilized instead of or in addition to the top drive 116 to impart the rotary motion 117. The top drive 116 and the connected drill string 120 may be suspended from the wellsite structure 112 via hoisting equipment, which may include a traveling block 118, a crown block (not shown), and a drawworks 119 storing a support cable or line 123. The crown block may be connected to or otherwise supported by the wellsite structure 112 and the traveling block 118 may be coupled with the top drive 116, such as via a hook. The drawworks 119 may be mounted on or otherwise supported by the rig floor 114. The crown block and traveling block 118 may comprise one or more pulleys or sheaves, whereby the support line 123 may be reeved around the pulleys or sheaves to operatively connect the crown block and the traveling block 18. The support line 123 may extend from the crown block to the drawworks 119, which may selectively impart tension to the support line 123 to lift and lower the top drive 116. The drawworks 119 may comprise a drum, a frame, and a prime mover (e.g., an engine or motor) (not shown) operable to drive the drum to rotate and reel in the support line 123, which in turn may cause the traveling block 118 and top drive 116 to move upward. The drawworks 119 may be operable to release the support line 123 via a controlled rotation of the drum, which in turn may cause the traveling block 118 and top drive 116 may move downward.

The top drive 116 may include a grabber, a swivel (neither shown), a tubular handling assembly 127 terminating with an elevator 129, and a drive shaft 125 operatively connected with a prime mover (not shown). The drill string 120 may be mechanically coupled to the drive shaft 125 (e.g., with or without a sub saver between the drill string 120 and the drive shaft 125). The prime mover may drive the drive shaft 125, such as through a gear box or transmission (not shown), to rotate the drive shaft 125 and, therefore, the drill string 120, which in conjunction with operation of the drawworks 119, may advance the drill string 120 into the formation 106 and form the wellbore 102. The tubular handling assembly 127 and elevator 129 may permit the top drive 116 to handle tubulars (e.g., drill pipes, drill collars, casing joints, and the like, that are not mechanically coupled to the drive shaft 125). For example, when the drill string 120 is being tripped into or out of the wellbore 102, the elevator 129 may grasp the tubulars of the drill string 120 such that the tubulars may be raised and/or lowered via the hoisting equipment mechanically coupled to the top drive 116. The grabber may include a clamp that clamps onto a tubular when making up and/or breaking out a connection of a tubular with the drive shaft 125. The top drive 116 may have a guide system (not shown), such as rollers that track up and down a guide rail (not shown) on the wellsite structure 112. The guide system may aid in keeping the top drive 116 aligned with the wellbore 102 and in preventing the top drive 116 from rotating during drilling by transferring the reactive torque from the drill string 120 to the wellsite structure 112.

The drill string 120 may be conveyed within the wellbore 102 through a plurality of well control devices disposed at the wellsite surface 104 on top of the wellbore 102 below the rig floor 114. The well control devices may be operable to control pressure within the wellbore 102 via a series of pressure barriers formed between the wellbore 102 and the wellsite surface 104. The well control devices may include a blowout preventer (BOP) stack 130 and an annular fluid control device 132, such as an annular preventer and/or a rotating control device (RCD). The well control devices may be mounted on top of a wellhead 134.

The well construction system 100 may further include a drilling fluid circulation system operable to circulate fluids between the surface equipment 110 and the drill bit 126 during drilling and other operations. For example, the drilling fluid circulation system may be operable to inject a drilling fluid from the wellsite surface 104 into the wellbore 102 via an internal fluid passage 121 extending longitudinally through the drill string 120. The drilling fluid circulation system may comprise a pit, a tank, and/or other fluid container 142 holding drilling fluid 140, and a pump 144 operable to move the drilling fluid 140 from the container 142 into the fluid passage 121 of the drill string 120 via a fluid conduit 146 extending from the pump 144 to the top drive 116 and an internal passage extending through the top drive 116. The fluid conduit 146 may comprise one or more of a pump discharge line, a stand pipe, a rotary hose, and a gooseneck (not shown) connected with a fluid inlet of the top drive 116. The pump 144 and the container 142 may be fluidly connected by a fluid conduit 148.

A flow rate sensor 150 may be operatively connected along the fluid conduit 146 to measure flow rate of the drilling fluid 140 being pumped downhole. The flow rate sensor 150 may be operable to measure volumetric and/or mass flow rate of the drilling fluid 140. The flow rate sensor 150 may be an electrical flow rate sensor operable to generate an electrical signal and/or information indicative of the measured flow rate. The flow rate sensor 150 may be a Coriolis flowmeter, a turbine flowmeter, or an acoustic flowmeter, among other examples. A fluid level sensor 152 may be mounted or otherwise disposed in association with the container 142 and operable to measure level of the drilling fluid 140 within the container 142. The fluid level sensor 152 may be an electrical fluid level sensor operable to generate signals or information indicative of the amount (e.g., level, volume) of drilling fluid 140 within the container 142. The fluid level sensor 152 may comprise conductive, capacitive, vibrating, electromechanical, ultrasonic, microwave, nucleonic, and/or other example sensors. A flow check valve 154 may be connected downstream from the pump 144 to prevent the drilling or other fluids from backing up through the pump 144. A pressure sensor 156 may be connected along the fluid conduit 146, such as to measure pressure of the drilling fluid 140 being pumped downhole. The pressure sensor 156 may be connected close to the top drive 116, such as may permit the pressure sensor 156 to measure pressure within the drill string 120 at the top of the internal passage 121 or otherwise proximate the wellsite surface 104. The pressure sensor 156 may be an electrical sensor operable to generate electric signals and/or other information indicative of the measured pressure.

During drilling operations, the drilling fluid may continue to flow downhole through the internal passage 121 of the drill string 120, as indicated by directional arrow 158. The drilling fluid may exit the BHA 124 via ports 128 in the drill bit 126 and then circulate uphole through an annular space ("annulus") 108 of the wellbore 102 defined between an exterior of the drill string 120 and the wall of the wellbore 102, as indicated by directional arrows 159. In this manner, the drilling fluid lubricates the drill bit 126 and carries formation cuttings uphole to the wellsite surface 104. The drilling fluid may exit the annulus 108 via a wing valve, a bell nipple, or another ported adapter 136. The ported adapter 136 may be disposed below the annular fluid control device 132, above the BOP stack 130, or at another location along the well control devices permitting ported access or fluid connection with the annulus 108.

During drilling operations, the drilling fluid exiting the annulus 108 via the ported adapter 136 may be directed into a fluid conduit 160 and pass through various pieces of surface equipment 110 fluidly connected along the conduit 160, prior to being returned to the container 142 to be recirculated into the wellbore 102. For example, the drilling fluid may pass through a choke manifold 162 connected along the conduit 160. The choke manifold 162 may include at least one choke and a plurality of fluid valves (neither shown) collectively operable to control flow of the drilling fluid through the choke manifold 162. Backpressure may be applied to the annulus 108 by variably restricting flow of the drilling fluid or other fluids flowing through the choke manifold 162. The greater the restriction to flow through the choke manifold 162, the greater the backpressure applied to the annulus 108. Thus, downhole pressure (e.g., pressure at the bottom of the wellbore 102 around the BHA 124 or at a particular depth along the wellbore 102) may be regulated by varying the backpressure at an upper (i.e., uphole) end (e.g., within an upper portion) of the annulus 108 proximate the wellsite surface 104. Pressure maintained at the upper end of the annulus 108 may be measured via a pressure sensor 164 connected along the conduit 160 between the ported adapter 136 and the choke manifold 162 and, thus, in communication with the upper end of the annulus 108. A fluid valve 166 may be connected along the conduit 160 to selectively fluidly isolate the annulus 108 from the choke manifold 162 and/or other surface equipment 110 fluidly connected with the conduit 160. The fluid valve 166 may be or comprise fluid shut-off valves, such as ball valves, globe valves, and/or other types of fluid valves, which may be selectively opened and closed to permit and prevent fluid flow therethrough. The fluid valve 166 may be actuated remotely by a corresponding actuator operatively coupled with the fluid valve 166. The actuator may be or comprise an electric actuator, such as a solenoid or motor, or a fluid actuator, such as pneumatic or hydraulic cylinder or rotary actuator. The fluid valve 166 may also or instead be actuated manually, such as by a corresponding lever. A flow rate sensor 168 may be connected along the fluid conduit 160 to monitor flow rate of the drilling fluid or another fluid being discharged from the wellbore 102.

Before being returned to the container 142, the drilling fluid may be cleaned and/or reconditioned by solids and gas control equipment 170, which may include one or more of shakers, separators, centrifuges, and other drilling fluid cleaning devices. The solids control equipment 170 may be operable for separating and removing solid particles 141 (e.g., drill cuttings) from the drilling fluid returning to the surface 104. The solids and gas control equipment 170 may also comprise fluid reconditioning equipment, such as may remove gas and/or finer formation cuttings 143 from the drilling fluid. The fluid reconditioning equipment may include a desilter, a desander, a degasser 172, and/or the like. The degasser 172 may form or be mounted in association with one or more portions of the solids and gas control equipment 170. The degasser 172 may be operable for releasing and/or capturing formation gasses entrained in the drilling fluid discharged from the wellbore 102. The degasser 172 may be fluidly connected with one or more gas sensors 174 (e.g., gas detectors and/or analyzers) via a fluid conduit 176, such as may permit the formation gasses released and/or captured by the degasser 172 to be directed to and analyzed by the gas sensors 174. The gas sensors 174 may be operable for generating signals or information indicative of the presence and/or quantity of formation gasses released and/or captured by the degasser 172. The gas sensors 174 may be or comprise qualitative gas analyzers, which may be utilized for safety purposes, such as to detect presence of hazardous gases entrained within the drilling fluid. The gas sensors 174 may also or instead be or comprise quantitative gas analyzers, which may be utilized to detect levels or quantities of certain formation gasses, such as to perform formation evaluation. One or more gas sensors 178 (e.g., qualitative gas analyzers) may also or instead be located at the rig floor 114, such as to detect hazardous gasses being released from the wellbore 102.

During fluid treatment operations, the particle-free and gas-free drilling fluid may be transferred to the fluid container 142 while the solid particles 141 may be transferred to a solids container 143 (e.g., a reserve pit). In some examples, intermediate containers (i.e., tanks) (not shown) may be utilized to hold the drilling fluid 140 between the various portions of the solids and gas control equipment 170. The container 142 may include an agitator (not shown) to maintain uniformity of the drilling fluid 140 contained therein. A hopper (not shown) may be disposed in a flowline between the container 142 and the pump 144 to introduce a chemical additive, such as caustic soda, into the drilling fluid 140.

The surface equipment 110 may further include other tubular handling equipment operable to store, move, connect, and disconnect tubulars to assemble and disassemble the conveyance means 122 of the drill string 120 during drilling operations. For example, a catwalk 131 may be utilized to convey tubulars from a ground level, such as along the wellsite surface 104, to the rig floor 114, permitting the tubular handling assembly 127 to grab and lift the tubulars above the wellbore 102 for connection with previously deployed tubulars. The catwalk 131 may have a horizontal portion and an inclined portion that extends between the horizontal portion and the rig floor 114. The catwalk 131 may comprise a skate 133 movable along a groove (not shown) extending longitudinally along the horizontal and inclined portions of the catwalk 131. The skate 133 may be operable to convey (e.g., push) the tubulars along the catwalk 131 to the rig floor 114. The skate 133 may be driven along the groove by a drive system, such as a pulley system or a hydraulic system, among other examples. Additionally, one or more racks (not shown) may adjoin the horizontal portion of the catwalk 131. The racks may have a spinner unit (not shown) for transferring tubulars to the groove of the catwalk 131.

An iron roughneck 151 may be positioned on the rig floor 114. The iron roughneck 151 may comprise a torqueing portion 153, such as may include a spinner and a torque wrench comprising a lower tong and an upper tong. The torqueing portion 153 of the iron roughneck 151 may be moveable toward and at least partially around the drill string 120, such as may permit the iron roughneck 151 to make up and break out a connection of the drill string 120. The torqueing portion 153 may also be moveable away from the drill string 120, such as may permit the iron roughneck 151 to move clear of the drill string 120 during drilling operations. The spinner of the iron roughneck 151 may be utilized to apply low torque to make up and break out threaded connections between tubulars of the drill string 120, while the torque wrench may be utilized to apply a higher torque to tighten and loosen the threaded connections.

A reciprocating slip 161 may be located on the rig floor 114, such as may accommodate therethrough the conveyance means 122 during make up and break out operations and during the drilling operations. The reciprocating slip 161 may be in an open position during drilling operations to permit advancement of the drill string 120 therethrough, and the reciprocating slip 161 may be in a closed position to clamp an upper end of the conveyance means 122 (e.g., assembled tubulars) to suspend the drill sting 120 and prevent advancement of the drill string 120 within the wellbore 102, such as during the make up and break out operations.

During drilling operations, the hoisting equipment may lower the drill string 120 while the top drive 116 rotates the drill string 120 to advance the drill string 120 downward within the wellbore 102 and through the formation 106. During the advancement of the drill string 120, the reciprocating slip 161 is in an open position, and the iron roughneck 151 is moved away or is otherwise clear of the drill string 120. When the upper portion of the tubular in the drill string 120 that is made up to the top drive 116 is near to the reciprocating slip 161 and/or rig floor 114, the top drive 116 ceases rotating the drill string 120 and the reciprocating slip 161 closes to clamp the conveyance means 122. The grabber of the top drive 116 clamps the upper portion of the tubular made up to the drive shaft 125. Once clamped, the drive shaft 125 rotates in a direction reverse from the drilling rotation to break out the connection between the drive shaft 125 and the drill string 120. The grabber of the top drive 116 may then release the tubular of the drill string 120.

Multiple tubulars may be loaded on the rack of the catwalk 131 and individual tubulars may be transferred from the rack to the groove in the catwalk 131, such as by the spinner unit. A tubular positioned in the groove may be conveyed along the groove by the skate 133. As the tubular is conveyed (e.g., pushed) along the groove by the skate 133, an end of the tubular may reach the inclined portion of the catwalk 131 and be conveyed along the incline to the rig floor 114. After the tubular is conveyed such that an end of the tubular projects above the rig floor 114, the elevator 129 may be able to grasp around the end of the tubular permitting the drawworks 119 to lift the tubular via the top drive 116.

With the connection between the drill string 120 and the drive shaft 125 broken out and with the elevator 129 grasping the tubular, the hoisting equipment may raise the elevator 129 to raise the traveling block 118 and, thus, the top drive 116, the elevator 129, and the tubular. The tubular suspended by the elevator 129 may be aligned with the upper portion of the drill string 120. The iron roughneck 151 may be moved toward the drill string 120 and the lower tong of the torqueing portion 153 may clamp onto the upper portion of the drill string 120. The spinning system may then rotate the suspended tubular (e.g., a threaded male connector) into the upper portion of the drill string 120 (e.g., a threaded female connector). Once the spinning system has provided the low torque rotation to make up the connection between the suspended tubular and the upper portion of the drill string 120, the upper tong may clamp onto the suspended tubular and rotate the suspended tubular with high torque to complete making up the connection between the suspended tubular and the drill string 120. In this manner, the suspended tubular becomes a part of the conveyance means 122 of the drill string 120. The iron roughneck 151 may then release the drill string 120 and move clear of the drill string 120.

The grabber of the top drive 116 may then clamp onto the drill string 120. The drive shaft 125 (e.g., a threaded male connector) may be brought into contact with the drill string 120 (e.g., a threaded female connector) and rotated to make up a connection between the drill string 120 and the drive shaft 125. The grabber may then release the drill string 120, and the reciprocating slip 161 may be operated to the open position. Drilling operations may then resume.

The tubular handling equipment may further include a tubular handling manipulator (PHM) 163 disposed in association with a fingerboard 165. Although the PHM 163 and the fingerboard 165 are shown supported on the rig floor 114, it is to be understood that one or both of the PHM 163 and fingerboard 165 may be located on the wellsite surface 104 or another area of the well construction system 100. The fingerboard 165 provides storage (e.g., temporary storage) of tubulars 111 during various operations, such as during and between tripping out and tripping in the drill string 120. The PHM 163 may be operable to transfer the tubulars 111 between the fingerboard 165 and the drill string 120 (i.e., space above the suspended drill string 120). For example, the PHM 163 may include arms 167 terminating with clamps 169, such as may be operable to grasp and/or clamp onto one of the tubulars 111. The arms 167 of the PHM 163 may extend and retract and/or at least a portion of the PHM 163 may be rotatable and/or movable toward and away from the drill string 120, such as may permit the PHM 163 to transfer the tubular 111 between the fingerboard 165 and the drill string 120.

To trip out the drill string 120, the hoisting equipment may raise the top drive 116, the reciprocating slip 161 may close to clamp the drill string 120, and the elevator 129 may close around the drill string 120. The grabber of the top drive 116 may then clamp the upper portion of the tubular made up to the drive shaft 125. Once clamped, the drive shaft 125 may rotate in a direction reverse from the drilling rotation to break out the connection between the drive shaft 125 and the drill string 120. The grabber of the top drive 116 may then release the tubular of the drill string 120, and the drill string 120 may be suspended, at least in part, by the elevator 129. The iron roughneck 151 may be moved toward the drill string 120. The lower tong may clamp onto a lower tubular below a connection of the drill string 120, and the upper tong may clamp onto an upper tubular above the connection of the drill string 120. The upper tong may then rotate the upper tubular to provide a high torque to break out the connection between the upper and lower tubulars. Once the high torque has been provided, the spinning system may rotate the upper tubular to break out the connection, and the upper tubular may be suspended above the rig floor 114 by the elevator 129. The iron roughneck 151 may then release the drill string 120 and move clear of the drill string 120.

The PHM 163 may then move toward the tool string 120 to grasp with the clamps 169 the tubular suspended from the elevator 129. Once the clamps 169 have grasped the suspended tubular, the elevator 129 may open to release the tubular. The PHM 163 may then move away from the tool string 120 while grasping the tubular with the clamps 169, place the tubular in the fingerboard 165, and release the tubular to store the tubular in the fingerboard 165.

Once the tubular that was suspended by the elevator 129 is clear from the top drive 116, the top drive 116 may be lowered and the elevator 129 may grasp an upper portion of the drill string 120 projecting above the reciprocating slip 161 and/or rig floor 114. The reciprocating slip 161 may then be opened and the elevator 129 raised utilizing the hoisting equipment to raise the drill string 120. Once raised, the reciprocating slip 161 may close to clamp the drill string 120. The iron roughneck 151 may move to the drill string 120 and break out a subsequent connection between tubulars, as described above. The PHM 163 may then grasp the suspended tubular and place the tubular in the fingerboard 165, as described above. This process may be repeated until a full length of the drill string 120 is removed from the wellbore 102.

To trip in the drill string 120, the process described above for tripping out the drill string 120 may be reversed. To summarize, the PHM 163 may grasp a tubular (e.g., one of the tubulars 111) from the fingerboard 165 and transfer the tubular to the elevator 129 that grasps the tubular. If no portion of the drill string 120 has been advanced into the wellbore 102, the suspended tubular may be advanced into the wellbore 102 by lowering the elevator 129. If a portion of the drill string 120 has been advanced into the wellbore 102, the drill string 120 may be projecting above the reciprocating slip 161 and/or rig floor 114, and the reciprocating slip 161 may be in a closed position clamping the drill string 120. The iron roughneck 151 may then move to the drill string 120 and make up a connection between the drill string 120 and the suspended tubular, as described above. The reciprocating slip 161 may then open and the elevator 129 may be lowered to advance the drill string 120 into the wellbore 102. Once the drill string 120 has been advanced into the wellbore 102 such that the upper portion of the drill string 120 is near to the reciprocating slip 161, the reciprocating slip 161 may be closed to clamp the drill string 120, and the elevator 129 may be opened to release the drill string 120. The process may be repeated until the drill string 120 is advanced into the wellbore 102 such that the drill bit 126 contacts the bottom of the wellbore 102. The grabber of the top drive 116 may clamp the upper tubular of the drill string 120, and the drive shaft 125 may be driven to make up a connection with the drill string 120. The grabber may release the tubular and the drilling operations may resume.

The surface equipment 110 of the well construction system 100 may also comprise a control center 190 from which various portions of the well construction system 100, such as the hoisting system, the tubular handling system, the drilling fluid circulation system, the well control devices, and the BHA 124, among other examples, may be monitored and controlled. The control center 190 may be located on the rig floor 114 or another location of the well construction system 100, such as the wellsite surface 104. The control center 190 may contain or comprise a processing device 192 (e.g., a controller, a computer) operable to provide control to one or more portions of the well construction system 100 and/or operable to monitor operations of one or more portions of the well construction system 100. For example, the processing device 192 may be communicatively connected with the various surface and downhole equipment describe herein and operable to receive signals from and transmit signals to such equipment to perform various operations described herein. The processing device 192 may include an input device for receiving commands from a human wellsite operator 194 and an output device for displaying information to the wellsite operator 194. The processing device 192 may store executable programs and/or instructions, including for implementing one or more aspects of the operations described herein. Communication between the control center 190, the processing device 192, and the various wellsite equipment may be via wired and/or wireless communication means. However, for clarity and ease of understanding, such communication means are not depicted, and a person having ordinary skill in the art will appreciate that such communication means are within the scope of the present disclosure.

The well construction system 100 may further include a plurality of stationary or mobile cameras 196 disposed or utilized at various locations around and/or within the well construction system 100. The cameras 196 may be operable to capture photographs and/or videos of various components, portions, or subsystems of the well construction system 100 during drilling and other wellsite operations. The cameras 196 may be further operable to capture photographs and/or videos of the wellsite operators 194 and the actions they perform during or otherwise in association with the wellsite operations. For example, the cameras 196 may capture photographs and/or videos of the entire well construction system 100 and/or specific portions of the well construction system 100, such as the top drive 116, the iron roughneck 151, the PHM 163, the fingerboard 165, the catwalk 131, among other examples. The cameras 196 may further capture photographs and/or videos of the wellsite operator 194 performing wellsite operations, including while performing repairs to the well construction system 100 during a breakdown. The cameras 196 may be in signal communication with the control center 190, such as may permit the wellsite operators 194 to view various portions or components of the well construction system 100 on one or more audiovisual output devices, such as the processing device 192. The processing device 192 or another portion of the control center 190 may be operable to record photographs and/or video signals generated by the cameras 196.

A person of ordinary skill in the art will readily understand that a well construction system 100 within the scope of the present disclosure may include more or fewer components than what was described above and depicted in FIG. 1. Additionally, various components and/or subsystems of the well construction system 100 shown in FIG. 1 may include more or fewer components. For example, various engines, motors, hydraulics, actuators, valves, or the like that were not described herein, may be included as part of the well construction system 100 and are within the scope of the present disclosure.

Figure 2:
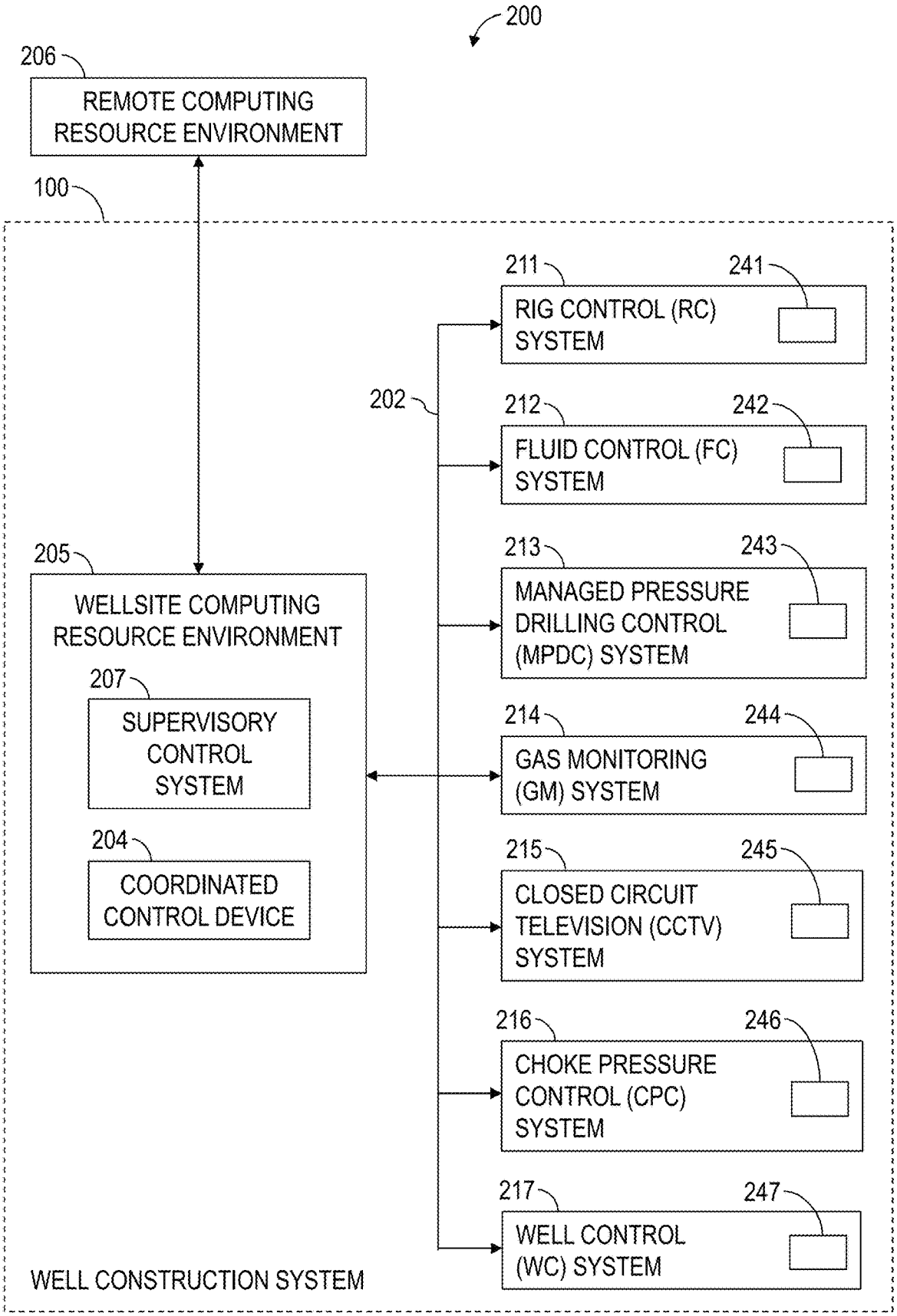
FIG. 2 is a schematic view of at least a portion of an example implementation of apparatus according to one or more aspects of the present disclosure.

FIG. 2 is a schematic view of at least a portion of an example implementation of a control system 200 for the well construction system 100 according to one or more aspects of the present disclosure. The following description refers to FIGS. 1 and 2 collectively.

The control system 200 may include a wellsite computing resource environment 205, which may be located at the wellsite 104 as part of the well construction system 100. The wellsite computing resource environment 205 may include a coordinated control device 204 and/or a supervisory control system 207. The control system 200 may further include a remote computing resource environment 206, which may be located offsite (i.e., not at the wellsite 104). The remote computing resource environment 206 may be communicatively connected with the wellsite computing resource environment 206 via a communication network. A "cloud" computing environment is one example of a remote computing resource. The cloud computing environment may communicate with the wellsite computing resource environment 205 via a network connection (e.g., a WAN or LAN connection). The control center 190 and/or the processing device 192 may be or form at least a portion of the wellsite computing resource environment 205.

As described above, the well construction system 100 may include various subsystems with different actuators and sensors for performing operations of the well construction system 100, such as may be monitored and controlled via the wellsite computing resource environment 205, the remote computing resource environment 206, and/or local controllers 241-247 (e.g., control systems) of the corresponding subsystems. Additionally, the wellsite computing resource environment 205 may provide for secured access to well construction system data to facilitate onsite and offsite user devices monitoring the well construction system 100, sending control processes to the well construction system 100, and the like.

The various subsystems of the well construction system 100 may include a rig control (RC) system 211, a fluid control (FC) system 212, a managed pressure drilling control (MPDC) system 213, a gas monitoring (GM) system 214, a closed circuit television (CCTV) system 215, a choke pressure control (CPC) system 216, and a well control (WC) system 217. The RC system 211 may include the wellsite structure 112, the hoisting equipment, such as the drawworks 119, the top drive 116, the rotary table, the kelly, the reciprocating slip 161, the drill pipe handling equipment, such as the catwalk 131, the PHM 163, the fingerboard 165, the iron roughneck 151, electrical generators, and other suitable equipment. Accordingly, the RC system 211 may perform power generation and drill pipe handling, hoisting, and rotation operations. The RC system 211 may also serve as a support platform for drilling equipment and staging ground for rig operations, such as connection make up operations described above. The FC system 212 may include, for example, the drilling fluid 140, the pumps 144, valves 166, drilling fluid loading equipment, the solids and gas treatment equipment 170, and other fluid control equipment. Accordingly, the FC system 212 may perform fluid operations of the well construction system 100. The MPDC system 213 may include, for example, the RCD 132, the choke manifold 162, the downhole pressure sensors 186, and other surface equipment. The GM system 214 may comprise the gas sensors 174, 178. The CCTV system 215 may include the plurality of cameras 196, communication equipment, and output devices (e.g., TV monitors) collectively operable to capture and display video of various portions or subsystems 211-217 of the well construction system 100. The CPC system 216 may comprise the choke manifold 162 and the WC system 217 may comprise the well control devices, such as the BOP stack 130 and an annular fluid control device 132.

The control system 200 may be in real-time communication with the various components of the subsystems 211-217. For example, the local controllers 241-247 may be in communication with various portions (e.g., sensors 221-227 and actuators 231-237, shown in FIG. 3) of corresponding subsystems 211-217 via local communication networks (not shown), while the wellsite computing resource environment 205 may be in communication with the subsystems 211-217 via a data bus or network 202. As described below, data or sensor signals generated by various sensors of the subsystems 211-217 may be made available for consumption by processes or devices of the control system 200. Similarly, data or control signals generated by the processes or devices of the control system 200 may be automatically communicated to various actuators of the subsystems 211-217 pursuant to predetermined programming to facilitate well construction operations or processed described herein.

The control system 200, via the coordinated control device 204 of the wellsite computing resource environment 205 and the local controllers 241-247, may be operable to monitor in real-time various sensors of the wellsite subsystems 211-217 and provide control commands to such subsystems 211-217, such that sensor data generated by the various sensors may be utilized to provide control commands to the subsystems 211-217 and other subsystems of the well construction system 100. Data may be generated by both sensors and computation, which may be utilized for coordinated control, such as for bottom hole pressure control.

Figure 3:
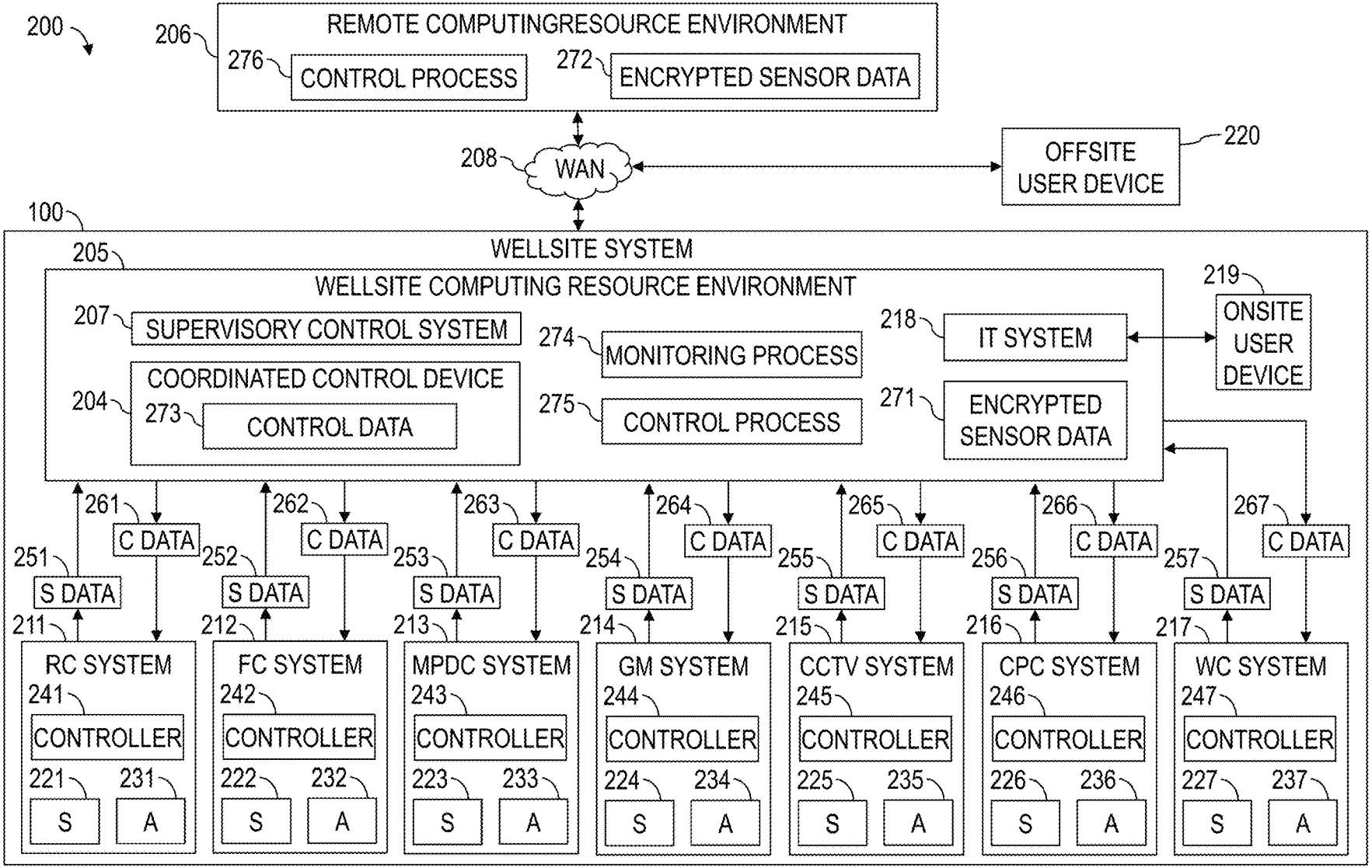
FIG. 3 is a schematic view of at least a portion of an example implementation of apparatus according to one or more aspects of the present disclosure.

FIG. 3 is a schematic view of an example implementation of the control system 200 shown in FIG. 2 according to one or more aspects of the present disclosure. The following description refers to FIGS. 1-3 collectively.

The wellsite computing resource environment 205 may be operable to communicate with offsite devices and systems utilizing a network 208 (e.g., a wide area network (WAN), such as the internet). The wellsite computing resource environment 205 may be further operable to communicate with the remote computing resource environment 206 via the network 208. FIG. 3 also shows the aforementioned subsystems 211-217 of the well construction system 100, such as the RC system 211, the FC system 212, the MPDC system 213, the GM system 214, the CCTV system 215, the CPC system 216, and the WC system 217. An example implementation of the well construction system 100 may include one or more onsite user devices 219, such as may be communicatively connected or otherwise interact with an information technology (IT) system 218 of the wellsite computing resource environment 205. The onsite user devices 219 may be or comprise stationary user devices intended to be stationed at the well construction system 100 and/or portable user devices. For example, the onsite user devices 219 may include a desktop, a laptop, a smartphone, a personal digital assistant (PDA), a tablet component, a wearable computer, or other suitable devices. The onsite user devices 219 may be operable to communicate with the wellsite computing resource environment 205 of the well construction system 100 and/or the remote computing resource environment 206. The IT system 218 may include communication conduits, software, computers, and other IT equipment facilitating communication between one or more portions of the wellsite computing resource environment 205 and/or between the wellsite computing resource environment 205 and another portion of the well construction system 100, such as the remote computing resource environment 206.

The control system 200 may further include one or more offsite user devices 220. The offsite user devices 220 may be or comprise a desktop, a laptop, a smartphone, a PDA, a tablet component, a wearable computer, or other suitable devices. The offsite user devices 220 may be operable to receive and/or transmit information (e.g., monitoring functionality) from and/or to the well construction system 100 via communication with the wellsite computing resource environment 205. The offsite user devices 220 may provide control processes for controlling operation of the various subsystems 211-218 of the well construction system 100. The offsite user devices 220 may be operable to communicate with the remote computing resource environment 206 via the network 208.

Figure 6:
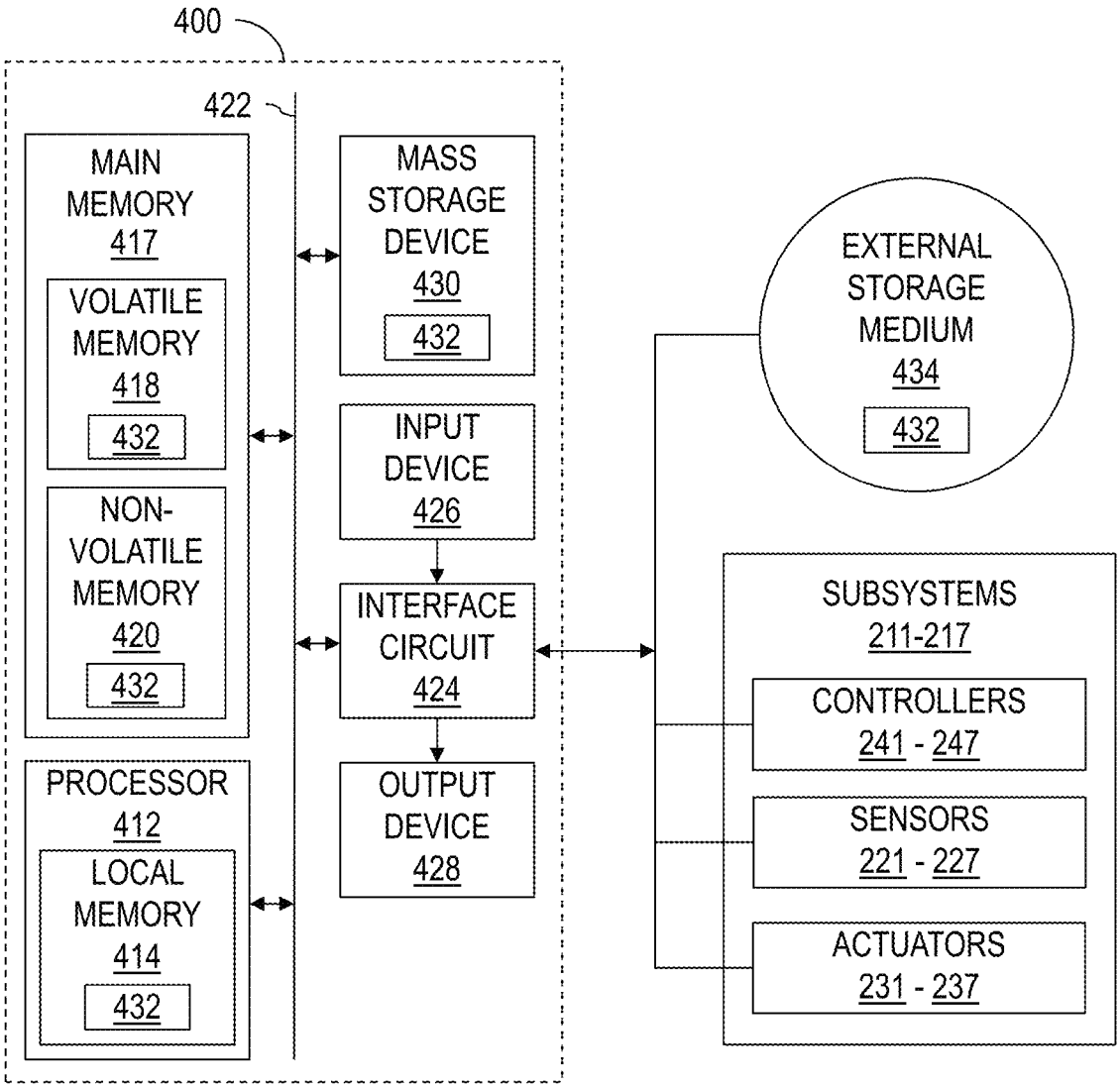
FIG. 6 is a schematic view of at least a portion of an example implementation of apparatus according to one or more aspects of the present disclosure.

The subsystems 211-217 of the well construction system 100 may include various corresponding (i.e., local) sensors, actuators, and controllers (e.g., programmable logic controllers (PLCs)), such as the processing device 400 shown in FIG. 6. The RC system 211 may include sensors (S) 221, actuators (A) 231, and controllers 241, the FC system 212 may include sensors 222, actuators 232, and controllers 242, the MPDC system 213 may include sensors 223, actuators 233, and controllers 243, the GM system 214 may include sensors 224, actuators 234, and controllers 244, the CCTV system 215 may include sensors 225, actuators 235, and controllers 245, the CPC system 216 may include sensors 226, actuators 236, and controllers 246, and the WC system 217 may include sensors 227, actuators 237, and controllers 247.

The sensors 221-227 may include suitable sensors for operation of the well construction system 100. For example, the sensors 221-227 may include cameras, position sensors, pressure sensors, temperature sensors, flow rate sensors, vibration sensors, current sensors, voltage sensors, resistance sensors, gesture detection sensors or devices, voice actuated or recognition devices or sensors, among other examples. The sensors 221-227 may be operable to provide sensor data to the wellsite computing resource environment 205 (e.g., to the coordinated control device 204). For example, the RC system sensors 221 may provide sensor data (S Data) 251, the FC system sensors 222 may provide sensor data 252, the MPDC system sensors 223 may provide sensor data 253, the GM system sensors 224 may provide sensor data 254, the CCTV system sensors 225 may provide sensor data 255, the CPC system sensors 226 may provide sensor data 256, and the WC system sensors 227 may provide sensor data 257. The sensor data 251-257 may include, for example, signals or information indicative of equipment operation status (e.g., on or off, up or down, set or release, etc.), drilling parameters (e.g., depth, hook load, torque, etc.), auxiliary parameters (e.g., vibration data of a pump), among other examples. The acquired sensor data 251-257 may include or be associated with a timestamp (e.g., date and/or time) indicative of when the sensor data 251-257 was acquired. Further, the sensor data 251-257 may be aligned with a depth or other drilling parameter.

Acquiring the sensor data 251-257 at the coordinated control device 204 may facilitate measurement of the same physical properties at different locations of the well construction system 100, wherein the sensor data 251-257 may be utilized for measurement redundancy to permit continued well construction operations. Measurements of the same physical properties at different locations may also be utilized for detecting equipment conditions among different physical locations at the wellsite surface 104 or within the wellbore 102. Variation in measurements at different wellsite locations over time may be utilized to determine equipment performance, system performance, scheduled maintenance due dates, and the like. For example, slip status (e.g., in or out) may be acquired from the sensors 221 and communicated to the wellsite computing resource environment 205. In another example implementation, acquisition of fluid samples may be measured by a sensor, such as the sensor 186, 223 and related with bit depth and time measured by other sensors. Acquisition of data from the cameras 196, 225 may facilitate detection of arrival and/or installation of materials or equipment at the well construction system 100. The time of arrival and/or installation of materials or equipment may be utilized to evaluate degradation of material, scheduled maintenance of equipment, and other evaluations.

The coordinated control device 204 may facilitate control of one or more of the subsystems 211-217 at the level of each individual subsystem 211-217. For example, in the FC system 212, sensor data 252 may be fed into the controller 242, which may respond to control the actuators 232. However, for control operations that involve multiple systems, the control may be coordinated through the coordinated control device 204. For example, coordinated control operations may include the control of downhole pressure during tripping. The downhole pressure may be affected by both the FC system 212 (e.g., pump rate), the MPDC 213 (e.g., choke position of the MPDC), and the RC system 211 (e.g. tripping speed). Thus, when it is intended to maintain certain downhole pressure during tripping, the coordinated control device 204 may be utilized to direct the appropriate control commands.

Control of the various subsystems 211-217 of the well construction system 100 may be provided via a three-tier control system that includes a first tier of the local controllers 241-247, a second tier of the coordinated control device 204, and a third tier of the supervisory control system 207. Coordinated control may also be provided by one or more controllers 241-247 of one or more of the subsystems 211-217 without the use of a coordinated control device 204. In such implementations of the control system 200, the wellsite computing resource environment 205 may provide control processes directly to these controllers 241-247 for coordinated control.

The sensor data 251-257 may be received by the coordinated control device 204 and utilized for control of the subsystems 211-217 of the well construction system 100. The sensor data 251-257 may be encrypted to produce encrypted sensor data 271. For example, in some embodiments, the wellsite computing resource environment 205 may encrypt sensor data from different types of sensors and systems to produce a set of encrypted sensor data 271. Thus, the encrypted sensor data 271 may not be viewable by unauthorized user devices (either offsite user devices 220 or onsite user devices 219) if such devices gain access to one or more networks of the well construction system 100. The encrypted sensor data 271 may include a timestamp and an aligned drilling parameter (e.g., depth) as described above. The encrypted sensor data 271 may be communicated to the remote computing resource environment 206 via the network 208 and stored as encrypted sensor data 272.

The wellsite computing resource environment 205 may provide the encrypted sensor data 271, 272 available for viewing and processing offsite, such as via the offsite user devices 220. Access to the encrypted sensor data 271, 272 may be restricted via access control implemented in the wellsite computing resource environment 205. The encrypted sensor data 271, 272 may be provided in real-time to offsite user devices 220 such that offsite personnel may view real-time status of the well construction system 100 and provide feedback based on the real-time sensor data. For example, different portions of the encrypted sensor data 271, 272 may be sent to the offsite user devices 220. The encrypted sensor data 271, 272 may be decrypted by the wellsite computing resource environment 205 before transmission or decrypted on the offsite user device 220 after encrypted sensor data is received. The offsite user device 220 may include a thin client (not shown) configured to display data received from the wellsite computing resource environment 205 and/or the remote computing resource environment 206. For example, multiple types of thin clients (e.g., devices with display capability and minimal processing capability) may be utilized for certain functions or for viewing various sensor data 251-257.

The wellsite computing resource environment 205 may include various computing resources utilized for monitoring and controlling operations such as one or more computers having a processor and a memory. For example, the coordinated control device 204 may include a processing device, such as the processing device 400 shown in FIG. 6, having a processor and memory for processing the sensor data, storing the sensor data, and issuing control commands responsive to the sensor data. As described above, the coordinated control device 204 may control various operations of the various subsystems 211-217 of the well construction system 100 via analysis of sensor data 251-257 from one or more of the wellsite subsystems 211-217 to facilitate coordinated control between the various subsystems of the well construction system 100, including the subsystems 211-217. The coordinated control device 204 may generate control data 273 (e.g., signals, commands, coded instructions) to execute control of the various systems of the well construction system 100 (e.g., wellsite subsystems 211-217). The coordinated control device 204 may transmit the control data 273 to one or more subsystems 211-217 of the well construction system 100. For example, control data (C Data) 261 may be sent to the RC system 211, control data 262 may be sent to the FC system 212, control data 263 may be sent to the MPDC system 213, control data 264 may be sent to the GM system 214, control data 265 may be sent to the CCTV system 215, control data 266 may be sent to the CPC system 216, and control data 267 may be sent to the WC system 217. The control data 261-267 may include, for example, human operator commands (e.g., turn on or off a pump, switch on or off a valve, update a physical property set-point, etc.). The coordinated control device 204 may include a fast control loop that directly obtains sensor data 251-257 and executes, for example, a control algorithm. The coordinated control device 204 may include a slow control loop that obtains data via the wellsite computing resource environment 205 to generate control commands.

The coordinated control device 204 may intermediate between the supervisory control system 207 and the local controllers 241-247 of the subsystems 211-217, such as may permit the supervisory control system 207 to control the subsystems 211-217 of the well construction system 100. The supervisory control system 207 may include, for example, devices for entering control commands to perform operations of the subsystems 211-217 of the well construction system 100. The coordinated control device 204 may receive commands from the supervisory control system 207, process such commands according to a rule (e.g., an algorithm based upon the laws of physics for drilling operations), and provide control data to one or more systems of the well construction system 100. The supervisory control system 207 may be provided by the wellsite operator 194 and/or process monitoring and control program. In such implementations, the coordinated control device 204 may coordinate control between discrete supervisory control systems and the subsystems 211-217 while utilizing control data 261-267 that may be generated based on the sensor data 251-257 received from the subsystems 211-217 and analyzed via the wellsite computing resource environment 205. The coordinated control device 204 may receive the control data 251-257 and then dispatch control data 261, including interlock commands, to each subsystem 211-217. The coordinated control device 204 may also or instead just listen to the control data 251-257 being dispatched to each subsystem 221-227 and then initiate the machine interlock commands to the relevant local controller 241-247.

The coordinated control device 204 may run with different levels of autonomy. For example, the coordinated control device 204 may operate in an advice mode to inform wellsite operators 194 to perform a specific task or take specific corrective action(s) based on sensor data 251-257 received from the various subsystems 211-217. While in the advice mode, the coordinated control device 204 may, for example, advise or instruct the wellsite operator 194 to perform standard work sequence when gas is detected on the rig floor 114, such as to close the annular BOP 132. Furthermore, if the wellbore 102 is gaining or losing drilling fluid 140, coordinated control device 204 may, for example, advise or instruct the wellsite operator 194 to modify the density of the drilling fluid 140, modify the pumping rate of the drilling fluid 140, and/or modify the pressure of the drilling fluid within the wellbore 102. The coordinated control device 204 may also operate in a system/equipment interlock mode, whereby certain operations or operational sequences are prevented based on the received sensor data 251-257. While operating in the interlock mode, the coordinated control device 204 may manage interlock operations among the various equipment of the subsystems 211-217 of the well construction system 100. For example, if a pipe ram of the BOP stack 130 is activated, the coordinated control device 204 may issue an interlock command to the RC system controller 241 to stop the drawworks 119 from moving the drill string 120. However, if a shear ram of the BOP stack 130 is activated, the coordinated control device 204 may issue an interlock command to the controller 241 to operate the drawworks 119 to adjust position of the drill string 120 within the BOP stack 130 before activating the shear ram such that the shear ram does not align with a shoulder of the tubulars forming the drill string 120. The coordinated control device 204 may also operate in an automated sequence mode, whereby certain operations or operational sequences are automatically performed based on the received sensor data 251-257. For example, the coordinated control device 204 may activate an alarm and/or stop or reduce operating speed of the pipe handling equipment when a wellsite operator 194 is detected close to a moving iron roughneck 151, the PHM, or the catwalk 131. Also, if the wellbore pressure increases rapidly, the coordinated control device 204 may, for example, close the annular BOP 132, one or more rams of the BOP stack 130, and/or adjust the choke manifold 162.

The wellsite computing resource environment 205 may comprise or execute a monitoring process 274 (e.g., an event detection process) that may utilize the sensor data 251-257 to determine information about status of the well construction system 100 and automatically initiate an operational action, a process, and/or a sequence of one or more of the subsystems 211-217. The monitoring process 274 may initiate the operational action to be caused by the coordinated control device 204. Depending on the type and range of the sensor data 251-257 received, the operational actions may be executed in the advice mode, the interlock mode, or the automated sequence mode. For example, the monitoring process 274 may determine a drilling state, equipment health, system health, a maintenance schedule, or combination thereof and initiate an advice to be generated. The monitoring process 274 may also detect abnormal drilling events, such as wellbore fluid loss and gain, wellbore washout, fluid quality issue, or equipment events based on job design and execution parameters (e.g., wellbore, drilling fluid, and drill string parameters), current drilling state, and real time sensor information from both the surface equipment 110 (e.g., presence of hazardous gas at the rig floor, presence of human wellsite operators in close proximity to moving pipe handling equipment) and the BHA 124, initiating an operational action in the automated mode. The monitoring process 274 may be connected to the real time communication network 202. The coordinated control device 204 may initiate a counteractive measure (e.g., a predetermined action, process, or operation) based on the events detected by the monitoring process 274.

The term "event" as used herein may include, but not be limited to, an operational and safety related event described herein and/or another operational and safety related event that can take place at a well construction system. The events described herein may be detected by the monitoring process 274 based on the sensor data 251-257 (e.g., sensor signals or information) received and analyzed by the monitoring process 274.

The wellsite computing resource environment 205 may also comprise or execute a control process 275 that may utilize the sensor data 251-257 to optimize drilling operations, such as, for example, the control of drilling equipment to improve drilling efficiency, equipment reliability, and the like. For example, the acquired sensor data 252 may be utilized to derive a noise cancellation scheme to improve electromagnetic and mud pulse telemetry signal processing. The remote computing resource environment 206 may comprise or execute a control process 276 substantially similar to the control process 275 that may be provided to the wellsite computing resource environment 205. The monitoring and control processes 274, 275, 276 may be implemented via, for example, a control algorithm, a computer program, firmware, or other suitable hardware and/or software.

The wellsite computing resource environment 205 may include various computing resources, such as, for example, a single computer or multiple computers. The wellsite computing resource environment 205 may further include a virtual computer system and a virtual database or other virtual structure for collected data, such as may include one or more resource interfaces (e.g., web interfaces) that facilitate the submission of application programming interface (API) calls to the various resources through a request. In addition, each of the resources may include one or more resource interfaces that facilitate the resources to access each other (e.g., to facilitate a virtual computer system of the computing resource environment to store data in or retrieve data from the database or other structure for collected data). The virtual computer system may include a collection of computing resources configured to instantiate virtual machine instances. A wellsite operator 194 may interface with the virtual computer system via the offsite user device 220 or the onsite user device 219. Other computer systems or computer system services may be utilized in the wellsite computing resource environment 205, such as a computer system or computer system service that provides computing resources on dedicated or shared computers/servers and/or other physical devices. The wellsite computing resource environment 205 may include a single server (in a discrete hardware component or as a virtual server) or multiple servers (e.g., web servers, application servers, or other servers). The servers may be, for example, computers arranged in physical and/or virtual configuration.

The wellsite computing resource environment 205 may also include a database that may be or comprise a collection of computing resources that run one or more data collections. Such data collections may be operated and managed by utilizing API calls. The data collections, such as the sensor data 251-257 may be made available to other resources in the wellsite computing resource environment 205 or to user devices (e.g., onsite user device 219 and/or offsite user device 220) accessing the wellsite computing resource environment 205. The remote computing resource environment 206 may include similar computing resources to those described above, such as a single computer or multiple computers (in discrete hardware components or virtual computer systems).

The control system 200 may provide an integral display or output means showing various information, such as the sensor data 251-257, the control data 261-267, processes taking place, events being detected, as well as drilling equipment operation status and control. The control system 200 may also provide a control human-machine interface (HMI), which may include one or more input means for receiving commands from the wellsite operators 194 to control the actuators 231-237 of a selected one of the subsystems 211-217 and an output means, such as a video output device (e.g., LCD screen). The input means may be provided via hardware controls, such as a physical buttons, slider bars, switches/rotary switches, joysticks, keyboards, mice, and the like. The control HMI may be implemented as part of utilized in association with the onsite and offsite user devices 219, 220.

Selected information from the operations of the subsystems 211-217 may be shown to the wellsite operator 194 via multiple display screens. Each display screen may display information related to a corresponding subsystem 211-217 and other selected information. Each display screen may integrate selected sensor data 251-257 from the corresponding subsystem 211-217 with information from the monitoring process 274, the control process 275, and/or the control data 261-267 generated by the coordinated control device 204 for display to the wellsite operator 194. The display screens may be shown or displayed alternately on a single video output device or simultaneously on a large video output device or multiple video output devices. When utilizing a single video output device, the display screen to be displayed may be selected by the wellsite operator 194 via the input means. The display screen to be displayed on the video output device may also or instead be selected automatically by the monitoring process 274 based operational events at the well construction system 100 (e.g., drilling process or event), such that information relevant to an event currently taking place is displayed. Each display screen may also include operational controls in the form of virtual or software buttons, toggles, levers, slide bars, and the like (e.g., on/off buttons, increase/decrease slide bars), such as may be utilized to select the display screen and/or control operation of the subsystem 211-217 associated with the display screen. The plurality of display screens described herein may be collectively referred to hereinafter as an integrated display.

The display screens may also display video (e.g., one or more video feeds) captured by one or more of the video cameras 196 of the CCTV system 215. The video may be displayed on a dedicated display screen or the video may be displayed in a dedicated area or embedded on a display screen showing other information. Source of the video (i.e., selection of the video feed or video camera 194) to be displayed on the display screen may be automated based on operational events (e.g., drilling events, drilling operation process) at the well construction system 100, such that video relevant to an event currently taking place is displayed.

Figure 4:
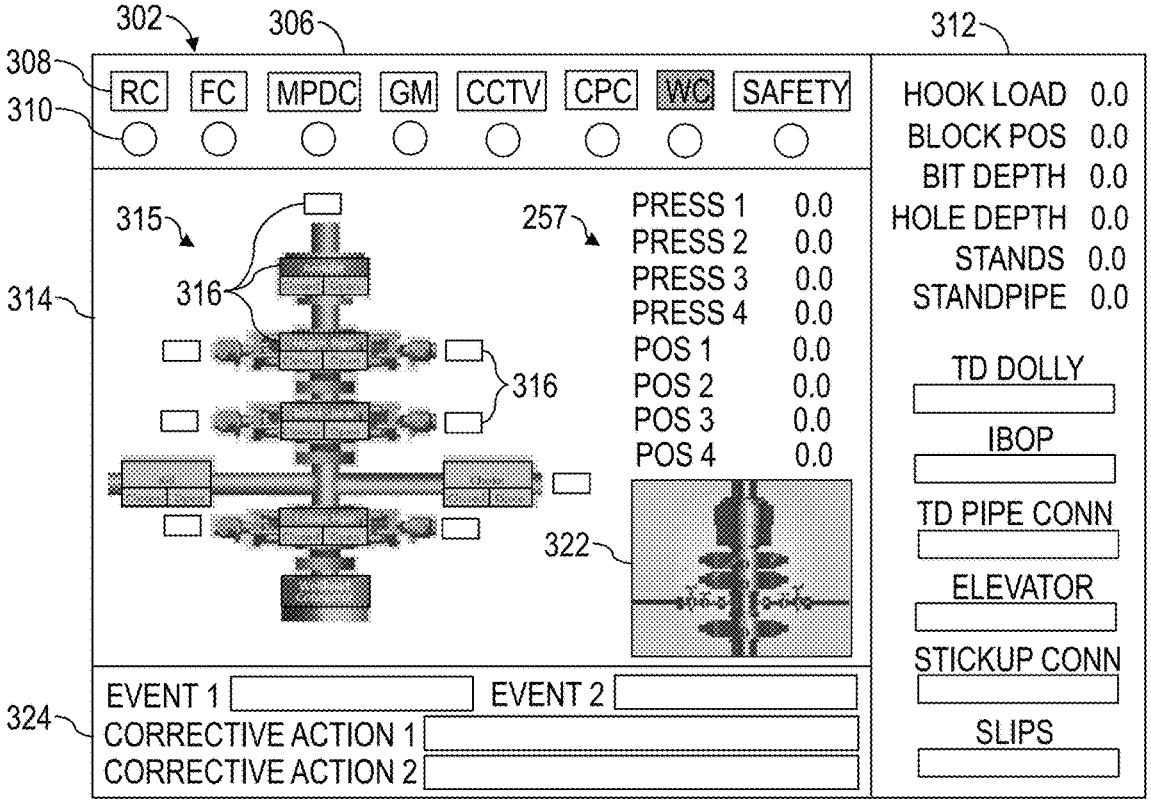
FIG. 4 is a view of at least a portion of an example implementation of apparatus according to one or more aspects of the present disclosure.
Figure 5:
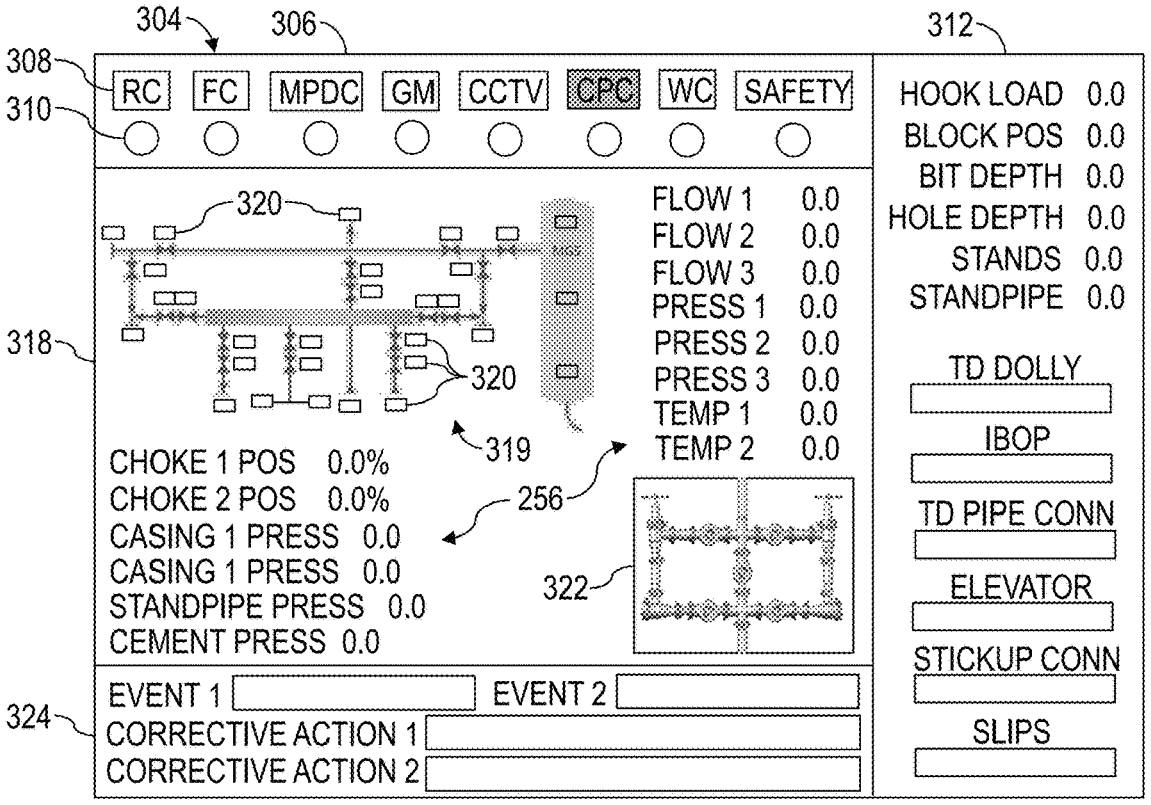
FIG. 5 is a view of at least a portion of an example implementation of apparatus according to one or more aspects of the present disclosure.

FIGS. 4 and 5 are views of example implementations of display screens 302, 304 of the integrated display generated by one or more portions of the control system 200 of the well construction system 100 according to one or more aspects of the present disclosure. The display screen 302 displays information related to the control and monitoring of the WC system 217 and other related drilling or equipment information, and the display screen 304 displays information related to the control and monitoring of the CPC system 216 and other related drilling or equipment information.

The display screens, including the display screens 302, 304, may comprise wellsite subsystem selector/indicator frame or area 306, which may be utilized to switch between or select which one or more of the display screens are being displayed on the video output device. The selector/indicator area 306 may by continuously displayed regardless of which display screen is being shown on the video output device. The area 306 may comprise a subsystem selection menu 308, such as a plurality of indicator bars or buttons, each listing a subsystem 211-217 of the well construction system 100. The wellsite operator 194 may click on one of the buttons to select and view the display screen and the associated subsystem information. The button associated with the selected subsystem 211-217 may light up to indicate which display screen and, thus, subsystem 211-217, is being shown. The selector/indicator area 306 may also include a SAFETY button, which may be selected to show the display screen with status of various safety equipment of the well construction system 100, including gas detectors 174, 178 and fire detectors. Although the subsystem selection menu 308 is shown as list that is permanently maintained on the display screens 302, 304, the subsystem selection menu 308 may be implemented as a dropdown menu, displaying the list of subsystems 211-217 when clicked or otherwise activated. The selector/indicator area 306 may also include a plurality of alarms or event indicators 310 (e.g., lights), each associated with a corresponding subsystem selection button. The monitoring process 274 may activate (e.g., light up, change color) one or more of the event indicators 310 to show or alarm a wellsite operator 194 of an event at or associated with a corresponding subsystem 211-217 that may be associated with a predetermined corrective action or another action by the wellsite operator 194. Responsive to the event indicator 310 being activated, the wellsite operator 194 may switch to a display screen corresponding to the activated event indicator to assess the event and/or implement appropriate counteractive measures or actions. Instead of manually changing between the display screens, the coordinated control device 205 or another portion of the well computing resource environment 205 may automatically change the display screen to show the display screen corresponding to a subsystem 211-217 experiencing the event.

The display screens, including the display screens 302, 304, may further comprise driller information frame or area 312 displaying selected sensor data 251-257 or information related to status of drilling operations. For example, the area 312 may include selected sensor data 251 from the RC system 211, selected sensor data 252 from the FC system 212, and/or selected sensor data from the WC system 217. The area 312 may display information such as hook load, traveling block position, drill bit depth, wellbore depth, number of stands or tubulars in the wellbore, standpipe pressure, total depth of dolly, inside BOP position, total depth pipe connection status, elevator status, stickup connection status, and slips status. The area 312 may be continuously displayed regardless of which display screen is being shown on the video output device.

Each display screen, including the display screens 302, 304, may further comprise a corresponding subsystem information frame or area 314, 318, respectively, displaying selected sensor data 251-257 or information related to a subsystem 211-217 being shown on the display screen. The information displayed in the area 314 may switch as the wellsite operator 194 or the wellsite computing resource environment 205 switches between the display screens of the integrated display.

The subsystem information area 314 of the display screen 302 may comprise a schematic view 315 of the BOP stack 130 and a plurality of status bars 316 indicative of status of corresponding portions of the BOP stack 130. The status bars 316 may display sensor data 257 showing operational parameters of the WC system 217 such as flow, pressure, temperature, and preventer position. The area 314 may further show the sensor data 257 of the WC system 217 in table or list form. One or more operational parameters (e.g., preventer position) of the WC system 217 may be changed, for example, by clicking or entering in the status bars 316 or on the list the intended values of the one or more operational parameters, causing the coordinated control device 204 to transmit corresponding control data 267 to the controller 247 of the WC system 217 to change the operational parameters as intended.

The subsystem information area 318 of the display screen 304 may comprise a schematic view 319 of the choke manifold 162 and a plurality of status bars 320 indicative of status of corresponding portions of the choke manifold 162. The status bars 320 may display sensor data 256 showing operational parameters of the CPC system 216 such as flow, pressure, temperature, and position. The area 318 may further show the sensor data 256 of the CPC system 216 in table or list form. One or more operational parameters of the CPC system 216 may be changed, for example, by entering in the status bars 320 or on the list the intended values of the one or more operational parameters, causing the coordinated control device 204 to transmit corresponding control data 266 to the controller 246 of the CPC system 216 to change the operational parameters as intended.

Each display screen, including the display screens 302, 304, may further comprise a CCTV frame or area 322 displaying a real-time camera view of one or more portions of the corresponding subsystem 211-217 being shown on the display screen. The view shown in the area 322 may be switched between different cameras 196 capturing the corresponding subsystem 211-217. For example, the area 322 of the display screen 302 may show a real-time view of the BOP stack 130 and the area 322 of the display screen 304 may show a real-time view of the choke manifold 162.

Each display screen, including the display screens 302, 304, may also comprise an event description frame or area 324 listing and/or describing one or more events taking place at the well construction system 100. The event description area 324 may also list and/or describe one or more counteractive measures (e.g., corrective actions, operational sequences) related to the event that may be performed or otherwise implemented in response to the event. Depending on the event and/or mode (e.g., advice, interlock, automated) the coordinated control device 204 is operating in, the wellsite computing resource environment 205 may just describe the corrective action within the event description area 324 and the wellsite operator 194 may implement such corrective action. However, the wellsite computing resource environment 205 may also or instead automatically implement the corrective action or cause the corrective action to be automatically implemented, such as by transmitting predetermined control data 261-267 to the controller 241-247 of the corresponding subsystem 211-217.

The information displayed in the area 324 may just display events and/or corrective actions related to the display screen and the subsystem 211-217 being viewed and, thus, change when switching between the display screens of the integrated display. However, the information displayed in the area 324 may not change when switching between the display screens and list events and/or corrective actions related to each subsystem 211-217, such as in chronological order or in the order of importance. As described above, the coordinated control device 204 or another portion of the well computing resource environment 205 may automatically change the display screen to show the subsystem 211-217 experiencing the event and the corresponding description and/or corrective action related to the event.

FIG. 6 is a schematic view of at least a portion of an example implementation of a processing device 400 according to one or more aspects of the present disclosure. The processing device 400 may form at least a portion of one or more electronic devices utilized at the well construction system 100. For example, the processing device 400 may be or form at least a portion of the processing devices 188, 192. The processing device 400 may form at least a portion of the control system 200, such as the coordinated control device 204, the supervisory control system 207, the local controllers 241-247, the onsite user devices 219, and the offsite user devices 220.

When implemented as part of the coordinated control device 204, the processing device 400 may be in communication with various sensors, actuators, controllers, and other devices of the subsystems 211-217 of the well construction system 100. The processing device 400 may be operable to receive coded instructions 442 from the wellsite operators 194 and the sensor data 251-257 generated by the sensors 221-227, process the coded instructions 442 and the sensor data 251-257, and communicate the control data 261-267 to the local controllers 241-247 and/or the actuators 231-237 to execute the coded instructions 442 to implement at least a portion of one or more example methods and/or operations described herein, and/or to implement at least a portion of one or more of the example systems described herein.

The processing device 400 may be or comprise, for example, one or more processors, special-purpose computing devices, servers, personal computers (e.g., desktop, laptop, and/or tablet computers), personal digital assistants, smartphones, internet appliances, and/or other types of computing devices. The processing device 400 may comprise a processor 412, such as a general-purpose programmable processor. The processor 412 may comprise a local memory 414, and may execute coded instructions 442 present in the local memory 414 and/or another memory device. The processor 412 may execute, among other things, the machine-readable coded instructions 442 and/or other instructions and/or programs to implement the example methods and/or operations described herein. The programs stored in the local memory 414 may include program instructions or computer program code that, when executed by an associated one or more processors of the control system 200, may cause the subsystems 211-217 of the well construction system 100 to perform the example methods and/or operations described herein. The processor 412 may be, comprise, or be implemented by one or more processors of various types suitable to the local application environment, and may include one or more of general-purpose computers, special-purpose computers, microprocessors, digital signal processors (DSPs), field-programmable gate arrays (FPGAs), application-specific integrated circuits (ASICs), and processors based on a multi-core processor architecture, as non-limiting examples. Of course, other processors from other families are also appropriate.

The processor 412 may be in communication with a main memory 417, such as may include a volatile memory 418 and a non-volatile memory 420, perhaps via a bus 422 and/or other communication means. The volatile memory 418 may be, comprise, or be implemented by random access memory (RAM), static random access memory (SRAM), synchronous dynamic random access memory (SDRAM), dynamic random access memory (DRAM), RAMBUS dynamic random access memory (RDRAM), and/or other types of random access memory devices. The non-volatile memory 420 may be, comprise, or be implemented by read-only memory, flash memory, and/or other types of memory devices. One or more memory controllers (not shown) may control access to the volatile memory 418 and/or non-volatile memory 420.

The processing device 400 may also comprise an interface circuit 424. The interface circuit 424 may be, comprise, or be implemented by various types of standard interfaces, such as an Ethernet interface, a universal serial bus (USB), a third generation input/output (3GIO) interface, a wireless interface, a cellular interface, and/or a satellite interface, among others. The interface circuit 424 may also comprise a graphics driver card. The interface circuit 424 may also comprise a communication device, such as a modem or network interface card to facilitate exchange of data with external computing devices via a network (e.g., Ethernet connection, digital subscriber line (DSL), telephone line, coaxial cable, cellular telephone system, satellite, etc.). One or more of the local controllers 241-247, the sensors 221-227, and the actuators 231-237 may be connected with the processing device 400 via the interface circuit 424, such as may facilitate communication between the processing device 400 and the local controllers 241-247, the sensors 221-227, and/or the actuators 231-237.

One or more input devices 426 may also be connected to the interface circuit 424. The input devices 426 may permit the wellsite operators 194 to enter the coded instructions 442, such as control commands, processing routines, and/or input data. The input devices 426 may be, comprise, or be implemented by a keyboard, a mouse, a joystick, a touch-screen, a track-pad, a trackball, an isopoint, and/or a voice recognition system, among other examples. One or more output devices 428 may also be connected to the interface circuit 424. The output devices 428 may be, comprise, or be implemented by video display devices (e.g., an LCD, an LED display, or cathode ray tube (CRT) display), printers, and/or speakers, among other examples. The processing device 400 may also communicate with one or more mass storage devices 440 and/or a removable storage medium 444, such as may be or include floppy disk drives, hard drive disks, compact disk (CD) drives, digital versatile disk (DVD) drives, and/or USB and/or other flash drives, among other examples.

The coded instructions 442 may be stored in the mass storage device 440, the main memory 417, the local memory 414, and/or the removable storage medium 444. Thus, the processing device 400 may be implemented in accordance with hardware (perhaps implemented in one or more chips including an integrated circuit, such as an ASIC), or may be implemented as software or firmware for execution by the processor 412. In the case of firmware or software, the implementation may be provided as a computer program product including a non-transitory, computer-readable medium or storage structure embodying computer program code (i.e., software or firmware) thereon for execution by the processor 412. The coded instructions 442 may include program instructions or computer program code that, when executed by the processor 412, may cause the various subsystems 211-217 of the well construction system 100 to perform intended methods, processes, and/or operations disclosed herein.

Figure 7:
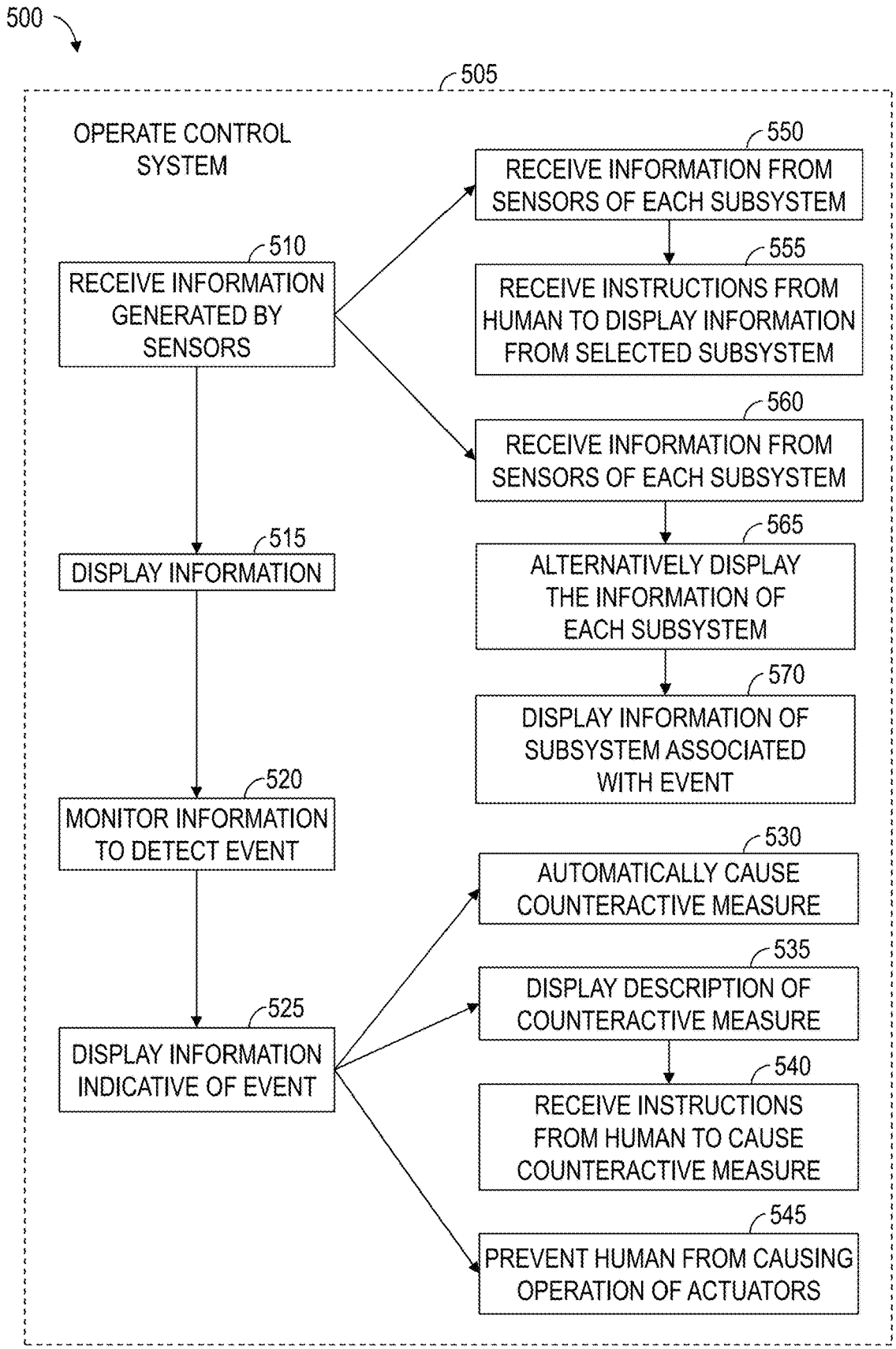
FIG. 7 is a flow-chart diagram of at least a portion of an example implementation of a method according to one or more aspects of the present disclosure.

FIG. 7 is a flow-chart diagram of at least a portion of an example implementation of a method (500) according to one or more aspects of the present disclosure. The method (500) described below and/or other operations described herein may be performed utilizing or otherwise in conjunction with at least a portion of one or more implementations of one or more instances of the apparatus shown in one or more of FIGS. 1-6 and/or otherwise within the scope of the present disclosure. However, the method (500) and operations described herein may be performed in conjunction with implementations of apparatus other than those depicted in FIGS. 1-6 that are also within the scope of the present disclosure. The method (500) and operations may be performed manually by one or more human operators 194 and/or performed or caused, at least partially, by the processing device 400 executing coded instructions 432 according to one or more aspects of the present disclosure. For example, the processing device 400 may receive input signals and automatically generate and transmit output signal to operate or cause a change in an operational parameter of one or more pieces of the wellsite equipment described above. However, the human operator 194 may also or instead manually operate the one or more pieces of wellsite equipment via the processing device 400 based on sensor signals displayed.

The method may comprise operating (505) a control system 200 of an oil and gas well construction system 100, wherein the control system 200 may comprise a processor 400 and memory 417 including computer program code 432. Operating (505) the control system 200 may comprise receiving (510) information generated by a plurality of sensors 221-227 of the well construction system 100, displaying (515) on a video output device 192, 219, 220, the received information, monitoring (520) the received information to detect an event at the well construction system 100 associated with a counteractive measure to be implemented in response to the detected event, and upon detection of the event, displaying (525) on the video output device 192, 219, 220 information indicative of the event.

Operating (505) the control system 200 may further comprise, upon detection of the event, automatically causing (530) the counteractive measure to be implemented, wherein the counteractive measure may comprise a predetermined operational sequence of one or more actuators 231-237 of the well construction system 100. Operating (505) the control system 200 may further comprise, upon detection of the event, displaying (535) on the video output device 192, 219, 220 a description of the counteractive measure to be implemented by a human operator 194, and receiving (540) from the human operator 194 instructions to cause the counteractive measure to be implemented. Operating (505) the control system 200 may still further comprise, upon detection of the event, preventing (545) a human operator 194 from causing operation of one or more predetermined actuators 231-237 of the well construction system 100.

In an implementation wherein the well construction system 100 comprises a plurality of subsystems 211-217, each of the plurality of subsystems 211-217 may comprise a corresponding plurality of subsystem sensors 221-227. Accordingly, operating (505) the control system 200 may further comprise, receiving (550) information generated by each plurality of subsystem sensors 221-227, and receiving (555) from the human operator 194 instructions selecting one of the plurality of subsystems 211-217 causing the control system 200 to display on the video output device 192, 219, 220 the information generated by a plurality of subsystem sensors 221-227 of the selected one of the plurality of subsystems 211-217. Operating (505) the control system 200 may also or instead comprise receiving (560) information generated by each plurality of subsystem sensors 221-227, alternatively displaying (565) on the video output device 192, 219, 220 the information generated by each plurality of subsystem sensors 221-227, and upon detection of the event, automatically displaying (570) on the video output device 192, 219, 220 the information generated by a plurality of subsystem sensors 221-227 of a subsystem 211-217 associated with the event.

In view of the entirety of the present disclosure, including the figures and the claims, a person having ordinary skill in the art will recognize that the present disclosure introduces an apparatus comprising: (A) a well construction system operable to form a wellbore within a subterranean formation at an oil and gas wellsite, wherein the well construction system comprises: (1) a rig control system operable to selectively move a drill string within the wellbore, wherein the rig control system comprises a first actuator operable to actuate at least a portion of the rig control system; and (2) a well pressure control system operable to control pressure within the wellbore, wherein the well pressure control system comprises a second actuator operable to actuate at least a portion of the well pressure control system; and (B) a wellsite control system comprising a processor and a memory storing computer program code, wherein the wellsite control system is communicatively connected with the first actuator and the second actuator, and wherein the wellsite control system is operable to: (1) generate a first control signal to operate the first actuator; and (2) generate a second control signal to operate the second actuator, wherein the first control signal is determined based on: (a) the computer program code; and (b) the second control signal.

The well pressure control system may comprise a BOP stack, and the second actuator may comprise a preventer of the BOP stack.

The rig control system may comprise a drill string hoisting system, and the first actuator may comprise a rotary or linear actuator of the drill string hoisting system selectively operable to move the drill string.

The rig control system may comprise a first sensor operable to generate a first signal indicative of operational status of the rig control system, the well pressure control system may comprise a second sensor operable to generate a second signal indicative of operational status of the well pressure control system, the wellsite control system may be communicatively connected with the first sensor and the second sensor, and the wellsite control system may be operable to detect an event associated with the rig control system based on the first signal and/or the well pressure control system based on the second signal. The wellsite control system may comprise an HMI comprising an input device and a video output device, and the wellsite control system may be operable to: display on the video output device the operational status of the rig control system and the operational status of the well pressure control system; and receive user input commands via the input device to control the rig control system and the well pressure control system. The wellsite control system may be operable to, upon detection of the event, automatically display on the video output device operational status of one or more portions of the well construction system related to the detected event. The wellsite control system may be operable to, based on the computer program code and the detected event, automatically display on the video output device a description of an operational sequence of the well construction system to be implemented by a human operator. The wellsite control system may be operable to, based on the computer program code and the detected event, automatically prevent a human operator from causing operation of the first actuator and/or the second actuator. The wellsite control system may be operable to, based on the computer program code and the detected event, automatically cause operation of the first actuator and/or the second actuator. The apparatus may comprise a plurality of video cameras at various locations of the oil and gas wellsite, each camera may be communicatively connected with the wellsite control system and operable to generate a corresponding video signal, and the wellsite control system may be operable to display on the video output device one or more video signals to show one or more portions of the well construction system. The wellsite control system may be operable to, upon detection of the event, automatically display on the video output device one or more video signals to show one or more portions of the well construction system related to the detected event.

The well construction system may comprise: a fluid control system operable to pump drilling fluid into the drill string and comprising a third actuator operable to actuate at least a portion of the fluid control system; and a managed pressure drilling control system operable to control bottom hole pressure of the wellbore and comprising a fourth actuator operable to actuate at least a portion of the choke control system. The wellsite control system may be communicatively connected with the third and fourth actuators, and the wellsite control system may be operable to: generate a third control signal to operate the third actuator; and generate a fourth control signal to operate the fourth actuator, wherein the first control signal is further based on the third control signal and the fourth control signal.

The present disclosure also introduces an apparatus comprising a control system for an oil and gas well construction system at a wellsite, wherein the control system comprises a processor and a memory storing computer program code, and wherein the control system is operable to: receive sensor information from a plurality of sensors of a plurality of subsystems of the well construction system; generate control signals to operate a plurality of actuators of the subsystems; display on a video output device the received sensor information; and detect an event associated with one or more of the subsystems based on the received sensor information.

The control system may be operable to, upon detecting the event and based on the computer program code, automatically cause a predetermined operation of one or more of the actuators.

The control system may be operable to, upon detecting the event and based on the computer program code, display on the video output device a description of an operation of one or more of the actuators to be implemented by a human operator.

The control system may be operable to, upon detecting the event and based on the computer program code, automatically prevent a human operator from causing operation of one or more of the actuators.

The control system may be operable to alternatively display on the video output device the sensor information received from each of the subsystems of the well construction system.

The control system may be operable to: generate a plurality of display screens to be alternatively displayed on the video output device, wherein each of the plurality of display screens shows an operational status of a corresponding subsystem of the well construction system; and automatically switch between ones of the plurality of display screens on the video output device based on the information received from the sensors.

The control system may comprise an HMI comprising an input device and the video output device, and the control system may be further operable to receive user input commands via the input device to control the actuators of the subsystems of the well construction system.

The apparatus may comprise a plurality of video cameras at various locations of the wellsite, and each camera may be communicatively connected with the control system and operable to generate a corresponding video signal. Upon detecting the event, the control system may be operable to automatically display on the video output device one or more video signals to show one or more portions of the well construction system related to the detected event.

The subsystems of the well construction system may comprise one or more of: a rig control system operable to selectively move a drill string within the wellbore; a well pressure control system operable to control pressure within the wellbore; a fluid control system operable to pump drilling fluid into the drill string; and a managed pressure drilling control system operable to control bottom hole pressure of the wellbore.

The present disclosure also introduces a method comprising operating a control system of an oil and gas well construction system, wherein the control system comprises a processor and memory including computer program code, and wherein operating the control system comprises: (A) receiving sensor information generated by a plurality of sensors of the well construction system; (B) displaying on a video output device the sensor information; (C) monitoring the sensor information to detect an operational event at the well construction system; and (D) upon detection of the operational event, displaying on the video output device information indicative of: (1) the detected operational event; and (2) a counteractive measure to be implemented in response to the detected operational event.

Operating the control system may comprise, upon detection of the operational event, automatically causing the counteractive measure to be implemented, and the counteractive measure may comprise a predetermined operational sequence of one or more actuators of the well construction system.

The information indicative of the counteractive measure may comprise a description of the counteractive measure to be implemented by a human operator, and operating the control system may comprise receiving from the human operator input commands to cause the counteractive measure to be implemented.

Operating the control system may comprise, upon detection of the operational event, preventing a human operator from causing operation of one or more predetermined actuators of the well construction system.

The well construction system may comprise a plurality of subsystems each comprising some of the sensors, and operating the control system may comprise receiving from a human operator an input command selecting one or more of the subsystems thereby causing the control system to display on the video output device the sensor information generated by the sensors of the subsystem experiencing the operational event.

The well construction system may comprise a plurality of subsystems each comprising some of the sensors, and operating the control system may comprise, upon detection of the operational event, automatically displaying on the video output device the sensor information generated by the sensors of the subsystem experiencing the operational event.

Operating the control system may comprise: receiving video feeds generated by a plurality of video cameras distributed at various locations of the well construction system; and, upon detection of the operational event, automatically displaying on the video output device a video feed from a corresponding one of the video cameras capturing a portion of the well construction system experiencing the detected operational event.

The present disclosure also introduces an apparatus comprising a control system comprising a processor and a memory storing computer program code, wherein the control system is communicatively connected with a plurality of sensors of each subsystem of a well construction system, wherein the control system is communicatively connected with a plurality of actuators of each subsystem, and wherein the control system is operable for generating on a video output device a display screen comprising: (A) a subsystem selection menu listing the subsystems, wherein the subsystem selection menu is operable by a human operator for selecting one or more of the subsystems; (B) a subsystem information area showing information generated by the sensors of the selected one or more of the subsystems; and (C) an operational event area showing information indicative of: (1) an operational event detected at the well construction system; and (2) a counteractive measure to be implemented in response to the detected operational event.

The subsystem information area may show one or more software control elements operable by the human operator via an input device for controlling the actuators of the selected one or more of the subsystems.

The subsystem information area may show a schematic of at least a portion of the selected one or more of the subsystems.

At least a portion of the information generated by the sensors of the selected one or more of the subsystems may be shown in association with the schematic.

The subsystems of the well construction system may comprise one or more of: a drill string hoisting system; a drill string rotating system; a drilling fluid circulating system; a BOP; and a choke manifold assembly.

The information indicative of the operational event may comprise information describing the detected operational event.

The information indicative of the counteractive measure to be implemented may comprise information describing the counteractive measure to be implemented by the human operator in response to the detected operational event.

The control system may be operable to automatically execute the counteractive measure in response to the detected operational event.

The display screen may comprise a driller information area showing information related to status of drilling operations. The information related to status of drilling operations may comprise one or more of wellbore depth, drill bit depth, number of stands in the wellbore, hook load, and traveling block position.

The control system may be communicatively connected with a plurality of video cameras distributed at various locations of the well construction system, and the display screen may comprise one or more video frames displaying video feeds from one or more corresponding video cameras.

The foregoing outlines features of several embodiments so that a person having ordinary skill in the art may better understand the aspects of the present disclosure. A person having ordinary skill in the art should appreciate that they may readily use the present disclosure as a basis for designing or modifying other processes and structures for carrying out the same purposes and/or achieving the same advantages of the embodiments introduced herein. A person having ordinary skill in the art should also realize that such equivalent constructions do not depart from the scope of the present disclosure, and that they may make various changes, substitutions and alterations herein without departing from the spirit and scope of the present disclosure.

The Abstract at the end of this disclosure is provided to permit the reader to quickly ascertain the nature of the technical disclosure. It is submitted with the understanding that it will not be used to interpret or limit the scope or meaning of the claims.

What is claimed is:

1. An apparatus comprising:

a well construction system operable to form a wellbore within a subterranean formation at an oil and gas wellsite, wherein the well construction system comprises:

a rig control system operable to selectively move a drill string within the wellbore, wherein the rig control system comprises a first actuator operable to actuate at least a portion of the rig control system;

a well pressure control system operable to control pressure within the wellbore, wherein the well pressure control system comprises a second actuator operable to actuate at least a portion of the well pressure control system;

a fluid control system operable to pump drilling fluid into the drill string and comprising a third actuator operable to actuate at least a portion of the fluid control system;

a managed pressure drilling control system operable to control bottom hole pressure of the wellbore and comprising a fourth actuator operable to actuate at least a portion of a choke control system; and a wellsite control system comprising a processor and a memory storing computer program code, wherein the wellsite control system is communicatively connected with the first actuator, the second actuator, the third actuator, and the fourth actuator, and wherein the wellsite control system is operable to:

generate a first control signal to operate the first actuator;

generate a second control signal to operate the second actuator;

generate a third control signal to operate the third actuator; and generate a fourth control signal to operate the fourth actuator, wherein the first control signal is determined based on: the computer program code, the second control signal, third control signal, and the fourth control signal.

2. The apparatus of claim 1 wherein the well pressure control system comprises a blowout preventer (BOP) stack, and wherein the second actuator comprises a preventer of the BOP stack.

3. The apparatus of claim 1 wherein the rig control system comprises a drill string hoisting system, and wherein the first actuator comprises a rotary or linear actuator of the drill string hoisting system selectively operable to move the drill string.

4. The apparatus of claim 1 wherein:

the rig control system further comprises a first sensor operable to generate a first signal indicative of operational status of the rig control system;

the well pressure control system further comprises a second sensor operable to generate a second signal indicative of operational status of the well pressure control system;

the wellsite control system is communicatively connected with the first sensor and the second sensor; and wherein the wellsite control system is further operable to detect an event associated with the rig control system based on the first signal and/or the well pressure control system based on the second signal.

5. The apparatus of claim 4 wherein the wellsite control system further comprises a human machine interface (HMI) comprising an input device and a video output device, and wherein the wellsite control system is further operable to:

display on the video output device the operational status of the rig control system and the operational status of the well pressure control system; and receive user input commands via the input device to control the rig control system and the well pressure control system.

6. The apparatus of claim 5 wherein the wellsite control system is further operable to, upon detection of the event, automatically display on the video output device operational status of one or more portions of the well construction system related to the detected event.

7. The apparatus of claim 5 wherein the wellsite control system is further operable to, based on the computer program code and the detected event, automatically display on the video output device a description of an operational sequence of the well construction system to be implemented by a human operator.

8. The apparatus of claim 5 wherein the wellsite control system is further operable to, based on the computer program code and the detected event, automatically prevent a human operator from causing operation of the first actuator and/or the second actuator.

9. The apparatus of claim 5 wherein the wellsite control system is further operable to, based on the computer program code and the detected event, automatically cause operation of the first actuator and/or the second actuator.

10. The apparatus of claim 5 further comprising a plurality of video cameras at various locations of the oil and gas wellsite, wherein each of the cameras is communicatively connected with the wellsite control system and operable to generate a corresponding video signal, and wherein the wellsite control system is further operable to, upon detection of the event, automatically display on the video output device one or more video signals to show one or more portions of the well construction system related to the detected event.

11. An apparatus comprising:

a control system for an oil and gas well construction system at a wellsite, wherein the control system comprises a processor and a memory storing computer program code, and wherein the control system is operable to:

receive sensor information from a plurality of sensors of a plurality of subsystems of the well construction system;

generate control signals to operate a plurality of actuators of the subsystems based on the received sensor information;

display on a video output device the received sensor information;

detect an abnormal drilling event associated with one or more of the subsystems based on the received sensor information; and upon detection of the abnormal drilling event, display on the video output device information indicative of the detected abnormal drilling event, and based on the computer program code, automatically prevent a human operator from causing operation of one or more of the actuators.

12. An apparatus comprising:

a control system for an oil and gas well construction system at a wellsite, wherein the control system comprises a processor and a memory storing computer program code, and wherein the control system is operable to:

receive sensor information from a plurality of sensors of a plurality of subsystems of the well construction system;

generate control signals to operate a plurality of actuators of the subsystems based on the received sensor information;

display on a video output device the received sensor information;

detect an abnormal drilling event associated with one or more of the subsystems based on the received sensor information;

upon detection of the abnormal drilling event, display on the video output device information indicative of the detected abnormal drilling event;

generate a plurality of display screens to be alternatively displayed on the video output device, wherein each of the plurality of display screens shows an operational status of a corresponding subsystem of the well construction system; and automatically switch between ones of the plurality of display screens on the video output device based on the information received from the sensors.

* * * * *